US009826296B2

(12) United States Patent
Chung et al.

(10) Patent No.: US 9,826,296 B2
(45) **Date of Patent: *Nov. 21, 2017**

(54) SPEAKER ASSEMBLY AND DISPLAY DEVICE INCLUDING SPEAKER ASSEMBLY

(71) Applicant: LG ELECTRONICS INC., Seoul (KR)

(72) Inventors: Brian Chung, Seoul (KR); Youngsung Kim, Seoul (KR); Sumin Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/075,745

(22) Filed: Mar. 21, 2016

(65) Prior Publication Data

US 2017/0164080 A1 Jun. 8, 2017

(30) Foreign Application Priority Data

Dec. 8, 2015 (KR) ..... 10-2015-0173790

(51) Int. Cl.
*H04R 9/06* (2006.01)
*H04R 1/02* (2006.01)

(52) U.S. Cl.
CPC ..... *H04R 1/026* (2013.01); *H04R 1/025* (2013.01); *H04R 1/028* (2013.01); *H04R 2499/15* (2013.01)

(58) Field of Classification Search
CPC ... H04R 1/00; H04R 5/02; H04R 1/02; H04R 1/025; H04R 1/026
USPC ..... 381/300, 305, 334, 182, 386, 395
See application file for complete search history.

(56) References Cited

U.S. PATENT DOCUMENTS

| | | | | |
|---|---|---|---|---|
| 5,833,186 | A | 11/1998 | Kosmoski et al. | |
| 8,229,152 | B2 * | 7/2012 | Sumitani | H04R 1/026 381/386 |
| 2005/0201571 | A1 | 9/2005 | Saint Vincent et al. | |
| 2006/0147080 | A1 * | 7/2006 | Wilson | H04R 1/026 381/386 |
| 2008/0123894 | A1 | 5/2008 | Lu | |

(Continued)

FOREIGN PATENT DOCUMENTS

| | | |
|---|---|---|
| KR | 20-2000-0012926 | 7/2000 |
| WO | WO 2013/125815 | 8/2013 |

OTHER PUBLICATIONS

International Search Report dated Aug. 24, 2016 issued in Application No. PCT/KR2016/002784.

(Continued)

*Primary Examiner* — Suhan Ni
(74) *Attorney, Agent, or Firm* — KED & Associates, LLP

(57) ABSTRACT

A speaker assembly and a display device including the speaker assembly are provided. The speaker assembly may include a first speaker, a first magnet provided on a side of the first speaker, a second speaker, a second magnet provided on a side of the second speaker that faces the side of the first speaker and having a magnetic polarity different from a magnetic polarity of the first magnet, a first bracket provided under the first speaker to support the first speaker, and a second bracket provided under the second speaker to support the second speaker, the second bracket configured to slide out from the first bracket.

13 Claims, 42 Drawing Sheets

(56) References Cited

U.S. PATENT DOCUMENTS

| | | | |
|---|---|---|---|
| 2008/0240487 | A1 | 10/2008 | Lee |
| 2011/0242738 | A1 | 10/2011 | Ye |
| 2011/0286613 | A1 | 11/2011 | Lipsky et al. |
| 2015/0248846 | A1 | 9/2015 | Kang et al. |

OTHER PUBLICATIONS

International Search Report dated Aug. 24, 2016 issued in Application No. PCT/KR2016/002785.
U.S. Office Action dated Nov. 3, 2016 in co-pending U.S. Appl. No. 15/076,734.
U.S. Notice of Allowance dated Feb. 23, 2017 issued in co-pending U.S. Appl. No. 15/076,734.

* cited by examiner

SPEAKER ASSEMBLY AND DISPLAY DEVICE INCLUDING SPEAKER ASSEMBLY

CROSS-REFERENCE TO RELATED APPLICATION

This application claims priority under 35 U.S.C. §119 to Korean Application No. 10-2015-0173790 filed on Dec. 8, 2015, whose entire disclosure is incorporated herein by reference.

BACKGROUND

Field

Embodiments relate to a speaker assembly and a display device including the speaker assembly.

Background

Various display devices, such as, e.g., liquid crystal displays (LCDs), plasma display panels (PDPs), electroluminescent displays (ELDs), vacuum fluorescent displays (VFDs), and organic light emitting diode (OLED) displays, have been studied and used to meet various demands for the display devices. An OLED display panel may display an image by depositing an organic material layer capable of emitting light on a substrate, at which transparent electrodes may be formed. The OLED display panel may be thin and flexible. Many studies on structural characteristics of display devices including the OLED display panel have been carried out. As display devices may be designed to have a thin or ultrathin profile, a speaker or a speaker assembly suitable for thin or ultrathin profile display devices may be needed. Further, development of technology that expands functions and/or reduce a size of the speaker assembly may extend sound range or provide higher quality sounds.

BRIEF DESCRIPTION OF THE DRAWINGS

The embodiments will be described in detail with reference to the following drawings in which like reference numerals refer to like elements wherein.

DETAILED DESCRIPTION

A display panel 100 may include a first long side, a second long side opposite the first long side, a first short side adjacent to the first long side and the second long side, and a second short side opposite the first short side. The first short side may be referred to as a first side area; the second short side may be referred to as a second side area opposite the first side area; the first long side may be referred to as a third side area which is adjacent to the first side area and the second side area and is positioned between the first side area and the second side area; and the second long side may be referred to as a fourth side area which is adjacent to the first side area and the second side area, is positioned between the first side area and the second side area, and is opposite to the third side area. Embodiments of the disclosure may describe that lengths of the first and second long sides may be longer than lengths of the first and second short sides for the sake of brevity and ease of reading. However, the lengths of the first and second long sides may be almost equal to the lengths of the first and second short sides.

A first direction may be a direction parallel to the long sides of the display panel 100, and a second direction may be a direction parallel to the short sides of the display panel 100. Further, a third direction may be a direction vertical to the first direction and/or the second direction. The first direction and the second direction may be commonly referred to as a horizontal direction, and the third direction may be referred to as a vertical direction. For example, the first direction may be X-axis direction, the second direction may be Y-axis direction, and the third direction may be Z-axis direction.

Figure 1:
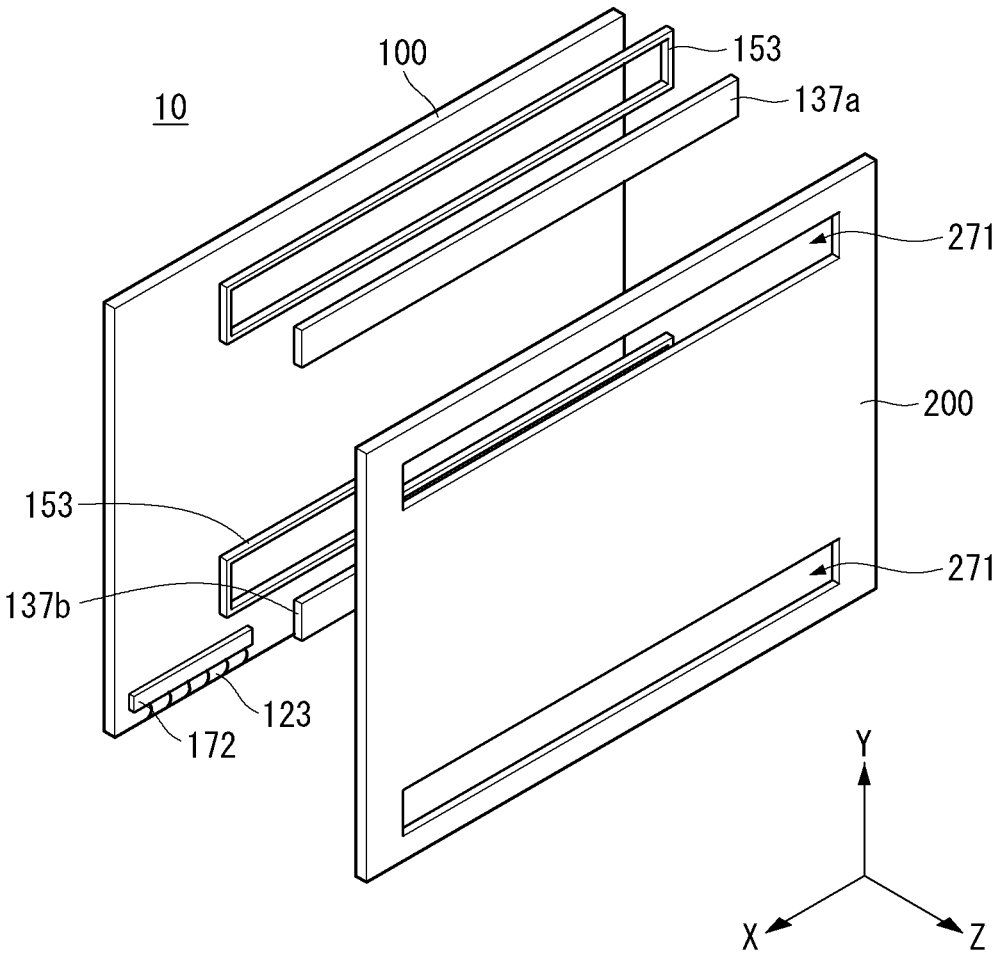
FIGS. 1 to 8B are views of a display device according to an embodiment.

FIGS. 1 to 8B are views of a display device according to an embodiment. Referring to FIG. 1, a body 10 of the display device may include a display panel 100, a bracket 153, a coupling part or coupler 137, and a back cover 200. The display panel 100 may be positioned in front of the body 10 and may display an image. The display panel 100 may divide the image into a plurality of pixels and may output the image while controlling color, brightness, and chroma of each pixel. The display panel 100 may have a rectangular shape. Other shapes may be used. For example, the display panel 100 may have a shape having a predetermined curvature at an edge. The display panel 100 may be an OLED display panel. Other display panels may be used. For example, a liquid crystal display panel may be used as the display panel 100.

At least one source printed circuit board (PCB) 172 may be positioned in at least a portion of a back surface of the display panel 100. The source PCBs 172 may be separated from each other. Signal lines for transmitting digital video data and timing control signals received from a timing controller board may be positioned on at least one source PCB 172. The source PCB 172 may be connected to the display panel 100 through a source chip-on film (COF) 123. The source COF 123 connected to one side of the source PCB 172 may extend to a lower surface of the display panel 100 and may be connected to the display panel 100.

The back cover 200 may be provided at a back surface of the display panel 100. The back cover 200 may be directly attached to the display panel 100. The back cover 200 may support the back surface of the display panel 100. The back cover 200 may increase rigidity of the display panel 100. Hence, the back cover 200 may include a lightweight material having high rigidity. For example, the back cover 200 may include aluminum.

A coupling hole 271 may be positioned on each of both sides of the back cover 200. For example, the coupling hole 271 may be positioned on each of an upper side and a lower side of the back cover 200. The coupling holes 271 of the back cover 200 may face each other with respect to the first direction in the middle of the back cover 200. The coupling holes 271 may pass through the back cover 200. Each coupling hole 271 may have a shape extending in the first direction.

The bracket 153 and the coupling part 137 may be positioned between the display panel 100 and the back cover 200. The coupling part 137 may include a magnetic material. The bracket 153 and the coupling part 137 may be positioned at locations corresponding to the coupling holes 271 of the back cover 200. The bracket 153 may have a frame shape, of which a middle portion may be empty. The bracket 153 may increase rigidity of the coupling hole 271 of the back cover 200. Hence, the bracket 153 may be attached to a portion around the coupling hole 271 at a front surface of the back cover 200. The bracket 153 may be configured to surround the coupling hole 271. The bracket 153 may prevent a crack or damage of the coupling hole 271 when the bracket 153 is coupled with the back cover 200. The bracket 153 may include a metal material or a rubber material so as to increase the rigidity of the coupling hole 271.

The coupling part 137 may be positioned in at least a portion of the back surface of the display panel 100 corresponding to the coupling hole 271. The coupling part 137 may be positioned in the middle of the bracket 153. The coupling part 137 may be positioned in a portion surrounded by the bracket 153 and the coupling hole 271. However, the embodiment of the disclosure is not limited thereto. For example, the coupling part 137 may be out of a portion corresponding to the bracket 153 and the coupling hole 271. The coupling part 137 may include a first coupling part 137*a* and a second coupling part 137*b*. The first coupling part 137*a* and the second coupling part 137*b* may be separated from each other. A hook may be inserted into a separation portion between the first coupling part 137*a* and the second coupling part 137*b*. The first coupling part 137*a* may be positioned on one side of the body 10, and the second coupling part 137*b* may be positioned on another side opposite the one side of the body 10 with respect to the first direction. The coupling part 137 may include a magnetic material. The coupling part 137 may be attached to the back surface of the display panel 100. The coupling part 137 may be coupled with the display panel 100 through a screw. However, the embodiment of the disclosure is not limited thereto. For example, the coupling part 137 may be coupled with the display panel 100 through an adhesive.

Figure 2:
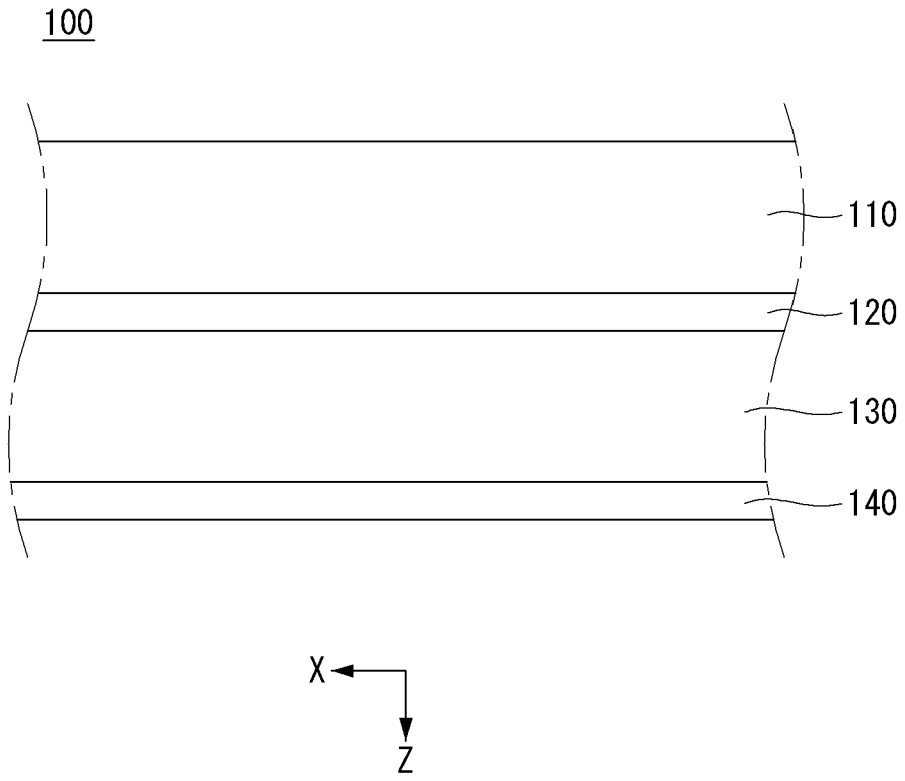

Referring to FIG. 2, the display panel 100 may include a transparent substrate 110, an upper electrode 120, an organic light emitting layer 130, and a lower electrode 140. The transparent substrate 110, the upper electrode 120, the organic light emitting layer 130, and the lower electrode 140 may be sequentially formed. The transparent substrate 110 and the upper electrode 120 may include a transparent material. The lower electrode 140 may include a material which is not transparent, but is not limited thereto. The lower electrode 140 may include a transparent material, for example, indium titanium oxide (ITO). In this instance, light may be emitted from one surface of the lower electrode 140. When a voltage is applied to the upper electrode 120 and the lower electrode 140, light emitted from the organic light emitting layer 130 may pass through the upper electrode 120 and the transparent substrate 110 and may be emitted to an outside. A light shielding plate may be additionally formed behind the lower electrode 140, so as to emit light emitted to the lower electrode 140 to the front.

The display device according to the embodiment may be an OLED display. The OLED display does not require a separate light source, and thus, may reduce a volume and a weight of the display device. Because a response speed of the OLED display is more than 1,000 times a response speed of a liquid crystal display, image retention may not be generated in the OLED display when the OLED display displays an image.

Figure 3A:
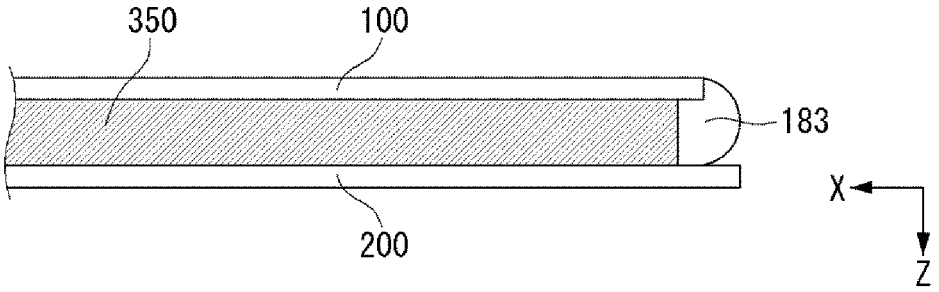

Referring to FIGS. 3A to 3D, the display device according to the embodiment may attach the display panel 100 to the back cover 200 through an adhesive sheet 350. The adhesive sheet 350 may include a double-sided tape, of which both surfaces may be used. The adhesive sheet 350 may have a predetermined thickness. Foreign substances or dust may enter between the display panel 100 and the back cover 200. As shown in FIG. 3A, a sealing member 183 may be sealed to at least one side of the adhesive sheet 350 so as to prevent foreign substances or dust from entering. The sealing member 183 may simultaneously shield the adhesive sheet 350 and at least one side of the display panel 100.

Figure 3B:
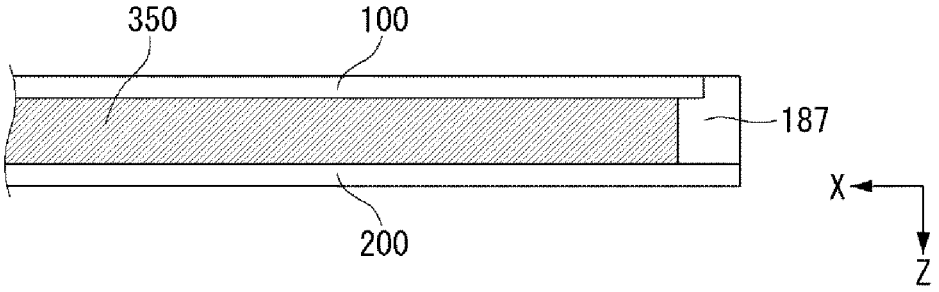

As shown in FIG. 3B, a frame 187 may be inserted into at least one side of the adhesive sheet 350. The frame 187 may adhere to at least one side of the adhesive sheet 350 and may bend so that one end of the frame 187 may extend toward the display panel 100. Hence, the frame 187 may simultaneously shield the adhesive sheet 350 and at least one side of the display panel 100.

Figure 3C:
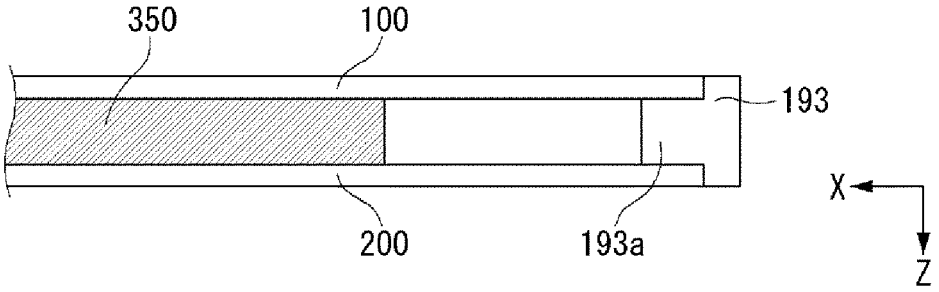

As shown in FIG. 3C, a middle cabinet 193 may be positioned between the display panel 100 and the back cover 200. The middle cabinet 193 may guide a connection location of the display panel 100. A flange 193*a* of the middle cabinet 193 may be inserted between the display panel 100 and the back cover 200. A body of the middle cabinet 193 may simultaneously shield the display panel 100 and at least one side of the back cover 200. The flange 193*a* of the middle cabinet 193 may be separated from the adhesive sheet 350. Hence, because the adhesive sheet 350 is not positioned entirely in the display panel 100, an amount of the adhesive sheet 350 required to manufacture the display device may decrease.

Figure 3D:
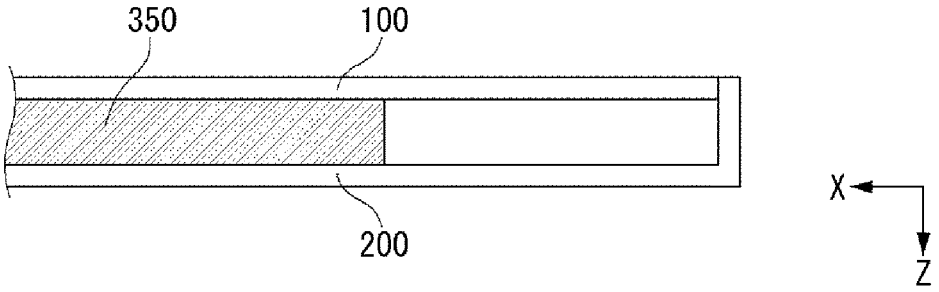

As shown in FIG. 3D, an edge of the back cover 200 may bend toward the display panel 100. Because the edge of the back cover 200 bends, at least one side of the adhesive sheet 350 may be shielded from the outside. In this instance, other materials may not be included between the display panel 100 and the back cover 200. Hence, a process for manufacturing the display device may be simplified, and manufacturing costs may be reduced. Further, the edge of the back cover 200 may be separated from the adhesive sheet 350. Hence, because the adhesive sheet 350 is not positioned entirely in the display panel 100, an amount of the adhesive sheet 350 required to manufacture the display device may decrease. In the following embodiments, description of structures on the side of the adhesive sheet 350 may be briefly made or may be omitted for the sake of brevity and ease of reading. The structures on the side of the adhesive sheet 350 may be applied to other embodiments.

Figure 4A:
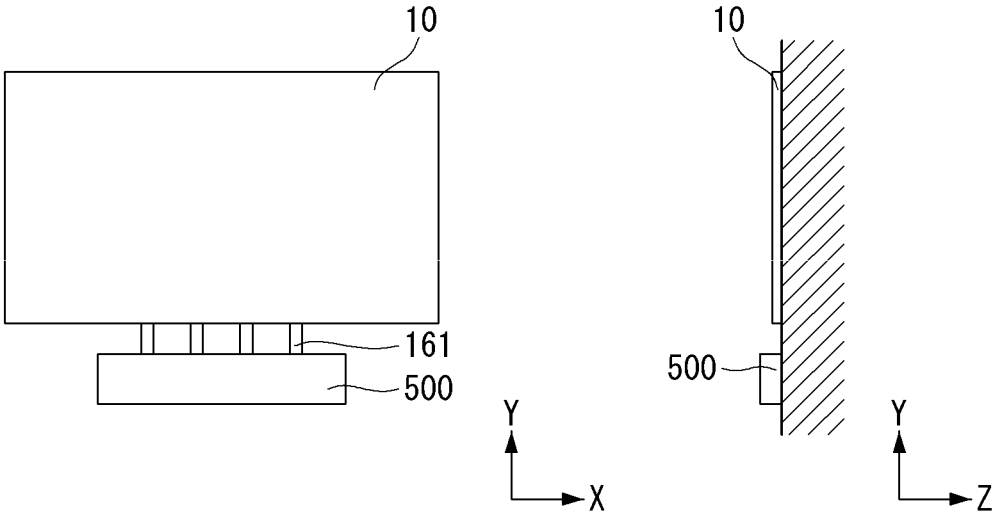
Figure 4B:
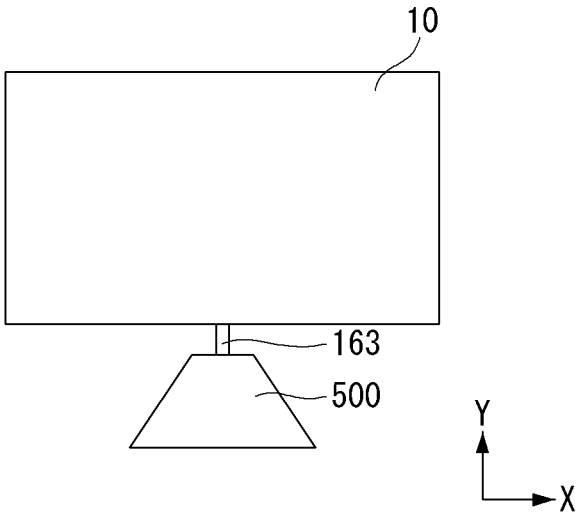
Figure 4C:
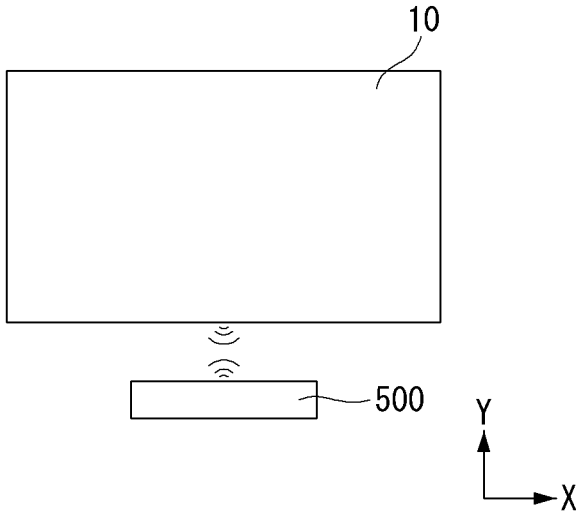

Referring to FIGS. 4A to 4C, the display device according to the embodiment may include a housing 500 electrically connected to the body 10. The housing 500 may transmit at least one signal to the body 10. The housing 500 may shield components that drive the display device. For example, the housing 500 may shield at least one printed circuit board (PCB). The housing 500 may not adhere to the body 10 and may be separated from the body 10. The housing 500 may not be positioned in or at a screen display portion of the display device. Hence, a user may further concentrate on the display screen.

For example, as shown in FIG. 4A, the housing 500 may be connected to the body 10 through a plurality of flat flexible cables (FFCs) 161. The FFC 161 may include a plurality of signal connection terminal pins and at least one ground terminal pin for connecting the housing 500 to the body 10. The FFC 161 may be cheaper than other cables. As shown in FIG. 4B, the housing 500 may be connected to the body 10 through one circular cable 163. Electrical signals may be transmitted through one circular cable 163, unlike in FIG. 4A, in which the electrical signals are transmitted through the plurality of FFCs 161. Because the housing 500 and the body 10 are connected through the one circular cable 163 and not the plurality of FFCs 161, the user may feel that an appearance of the display device may be neater and more attractive.

As shown in FIG. 4C, the housing 500 and the body 10 may exchange electrical signals with each other wirelessly. In this instance, the user may feel that the appearance of the display device may be neater and more attractive than the appearance of the display device in which the housing 500 and the body 10 are connected through the FFCs 161 or the circular cable 163. The body 10 and the housing 500 may be separated from each other. Hence, the user may further concentrate on the display screen, and also the display device including the thinner body 10 may be implemented.

Figure 5A:
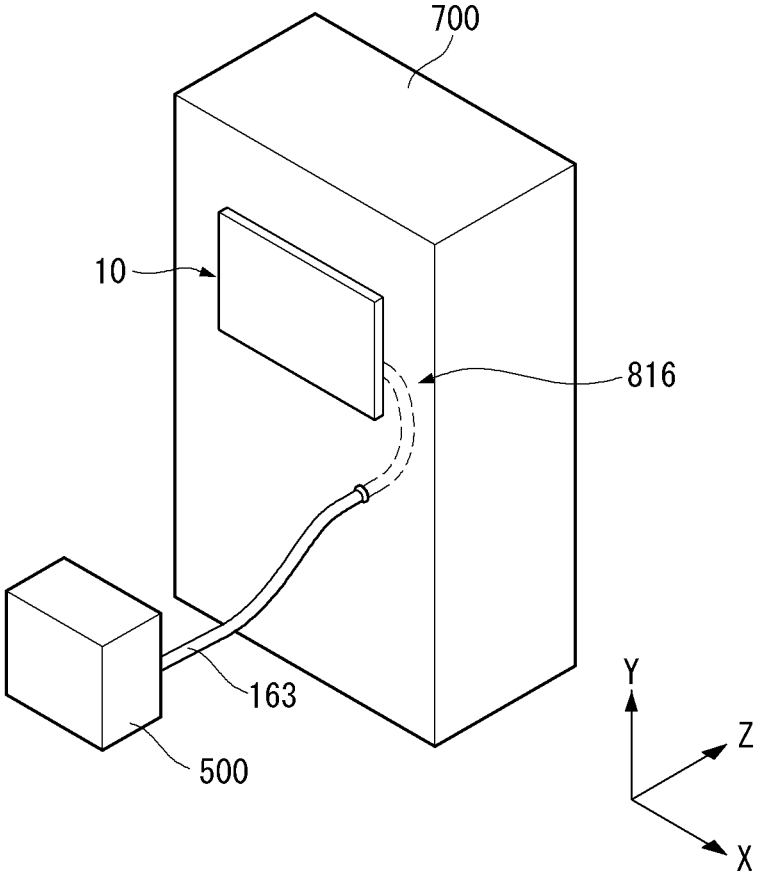
Figure 5B:
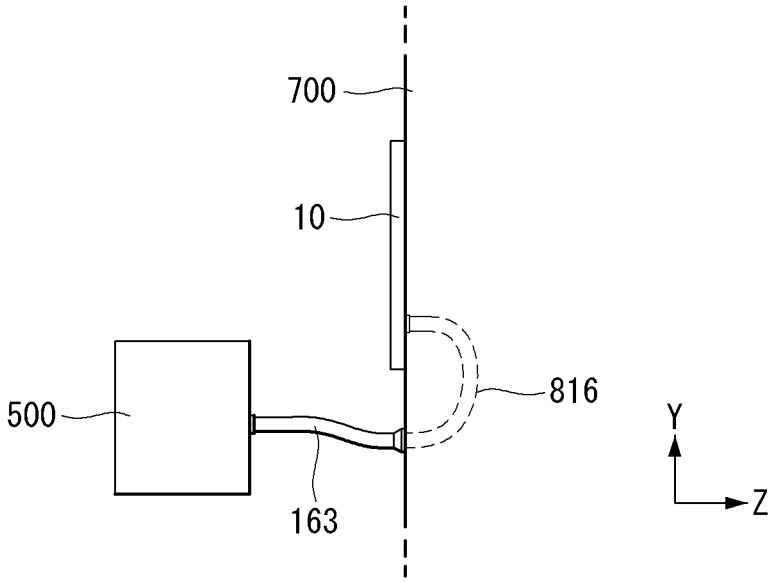

Referring to FIGS. 5A and 5B, the display device according to the embodiment may exchange electrical signals with the housing 500 through electrical wires 816 passing through a surface 700, to which the body 10 may be attached. One side of the source PCB of the body 10 may be connected to the electrical wires 816. The electrical wire 816 may be inserted into a portion of the surface 700, through which the electrical wire 816 passes. One side of the electrical wire 816 may be connected to the source PCB, and another side may be connected to the circular cable 163. The electrical wire 816 may be positioned inside the surface 700, and thus, may not be seen by the user.

The display device according to the embodiment may connect the body 10 to the housing 500 through the electrical wire 816 inserted inside the surface 700. Hence, it may look as if the body 10 and the housing 500 are not directly connected, and the user may feel that the appearance of the display device may be neater and more attractive and may further concentrate on the display screen.

Figure 6A:
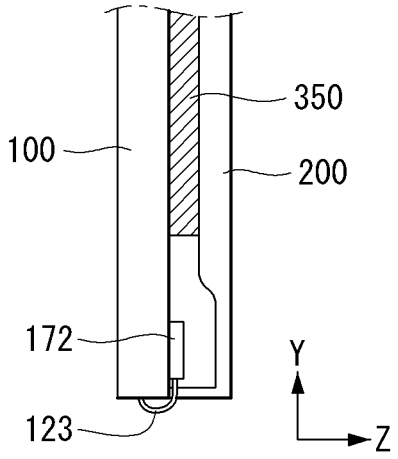
Figure 6B:
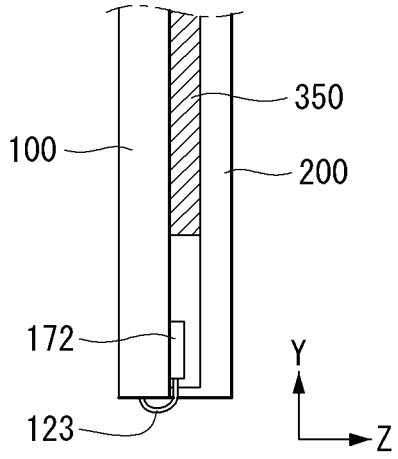
Figure 6C:
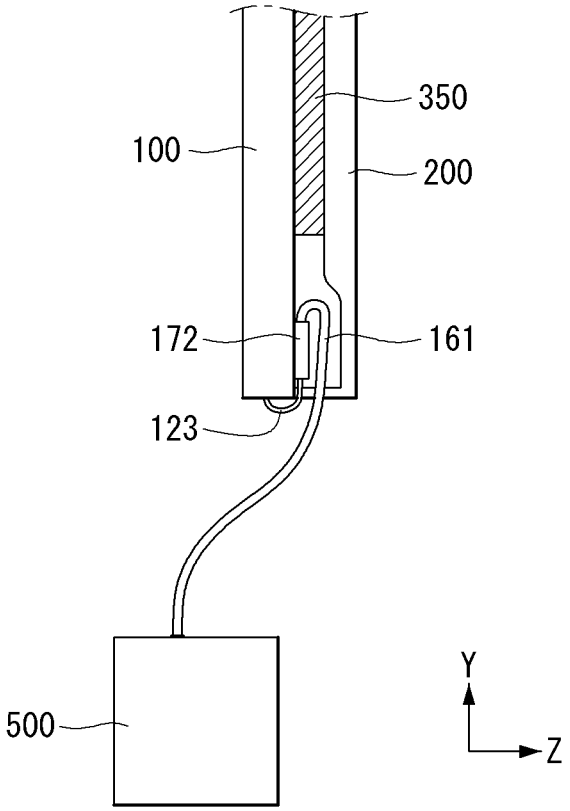

Referring to FIGS. 6A to 6C, the display device according to the embodiment may require a formation space of the source PCB 172 in the body 10. For example, as shown in FIG. 6A, a portion of the back cover 200 corresponding to the source PCB 172 may be inwardly depressed. The portion of the back cover 200 corresponding to the source PCB 172 may be thinner than another portion of the back cover 200. Because a thickness of the back cover 200 is not uniform, rigidity of the back cover 200 may be improved. Because the portion of the back cover 200 corresponding to the source PCB 172 is thinner than the other portion of the back cover 200, the source PCB 172 may be positioned on the back surface of the display panel 100 irrespective of a thickness of the adhesive sheet 350.

As shown in FIG. 6B, a portion of the back cover 200 corresponding to the source PCB 172 may have a same thickness as the other portion of the back cover 200. No portion of the back cover 200 may be depressed. In this instance, a thickness of the adhesive sheet 350 between the display panel 100 and the back cover 200 in the third direction may be greater than a thickness of the source PCB 172 in the third direction. Because the portion of the back cover 200 corresponding to the source PCB 172 has the same thickness as other portion of the back cover 200, a manufacturing process of the back cover 200 may be simplified, and manufacturing costs of the display device may be reduced.

As shown in FIG. 6C, the source PCB 172 may transmit an electrical signal to the housing 500 though a FFC 161. One side of the source PCB 172 may be connected to a source COF 123, and another side may be connected to the FFC 161. The FFC 161 may include a plurality of signal connection terminal pins and at least one ground terminal pin for connecting the housing 500 to the source PCB 172. The FFC 161 may be cheaper than other cables.

The display device according to the embodiment may position the source PCB 172 between the display panel 100 and the back cover 200. Thus, the back cover 200 may not require a hole or a cavity, a crack may not form in the back cover 200, and the rigidity of the back cover 200 may be improved. In the following embodiments, description of structures related to the source PCB 172 may be briefly made or may be omitted for the sake of brevity and ease of reading. The structures related to the source PCB 172 may be applied to other embodiments.

Figure 7A:
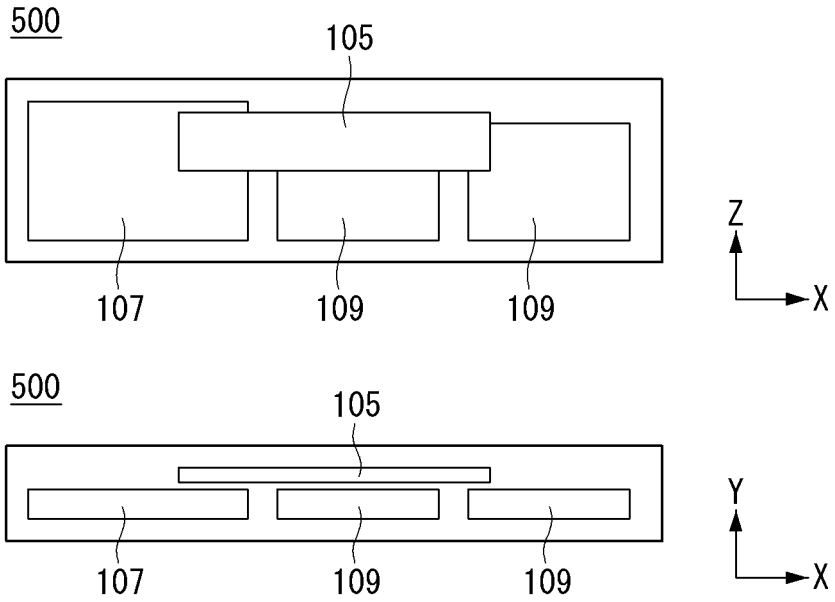
Figure 7B:
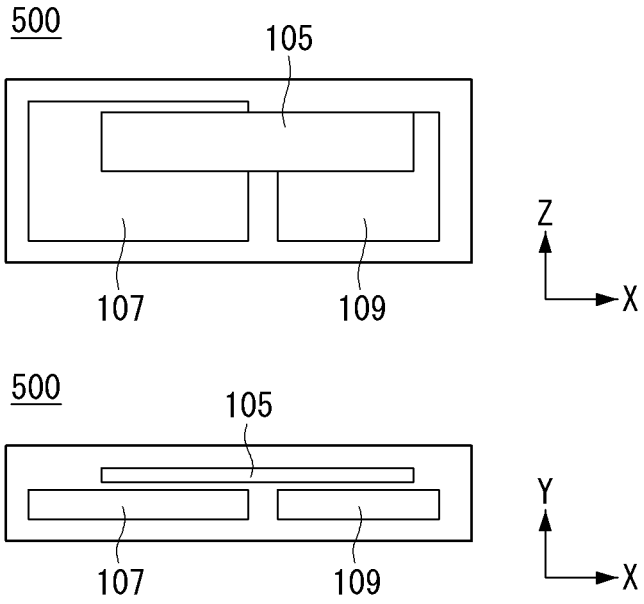

Referring to FIGS. 7A and 7B, at least one PCB may be positioned inside the housing 500. The PCBs may be separated from each other. For example, at least one PCB may be a main board 109. The main board 109 may provide an interface for operating the display device. Further, the main board 109 may check and control an operation state of the components of the display device, and thus, may maintain the components of the display device in an optimum state.

At least one PCB may be a power supply board 107. The power supply board 107 may supply electric power to the display device. The power supply board 107 may supply electric power to the body. The power supply board 107 may convert an AC frequency into a DC frequency. The power supply board 107 may convert a low frequency into a high frequency and may improve the electrical efficiency.

At least one PCB may be a timing controller board 105. The timing controller board 105 may transmit an input signal to the display panel 100. The timing controller board 105 may transmit timing signals CLK, LOAD, and SPi for controlling the source PCB and video signals R, G, and B to the source PCB. Further, the timing controller board 105 may control an image. The timing controller board 105 may be connected to the source PCB through one of the FFC, the circular cable, and the wireless communication.

As shown in FIG. 7A, the main boards 109 may be positioned respectively in a middle of the housing 500 and on a right side of the housing 500 and may be separated from each other. The power supply board 107 may be positioned opposite the main board 109 positioned on the right side of the housing 500 in a direction, for example, a long axis direction, of the housing 500 with respect to the middle of the housing 500.

The timing controller board 105 may be positioned on upper surfaces of the main boards 109 and the power supply board 107. Because the timing controller board 105 is positioned on the upper surfaces of the main boards 109 and the power supply board 107, an internal space of the housing 500 may be saved. A timing controller shield may be attached to a location where the timing controller board 105 may be mounted so as to block electromagnetic waves emitted from the power supply board 107 and the main boards 109. The timing controller board 105 may be connected to not the power supply board 107 and the main boards 109 but the timing controller shield. Hence, the timing controller board 105, the power supply board 107, and the main boards 109 may not interfere with one another, and the timing controller shield may protect the timing controller board 105 from impact. The timing controller board 105 may overlap the power supply board 107 and the main boards 109 in a height direction of the housing 500. Hence, the timing controller board 105 may be more easily connected to the power supply board 107 and the main boards 109.

As shown in FIG. 7B, one main board 109 may be mounted inside the housing 500. The main board 109 may be positioned on one side of the housing 500, and the power supply board 107 may be positioned opposite the main board 109 in the long axis direction of the housing 500. Because the display device according to the embodiment positions the timing controller board 105 on the power supply board 107 and the main board 109, a space of the housing 500 may be saved. Hence, the user may feel that the appearance of the display device may be improved because of a reduction in the size of the housing 500.

Figure 8A:
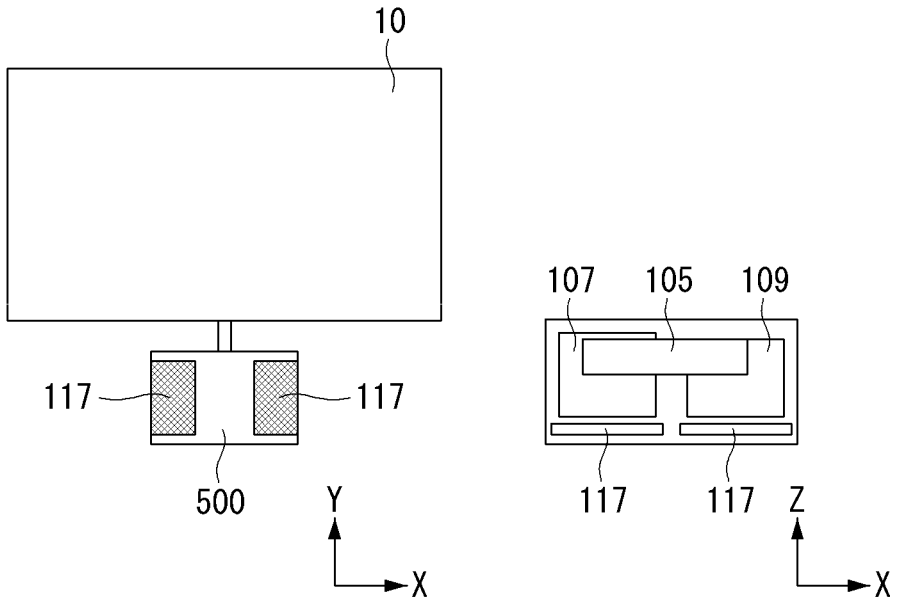
Figure 8B:
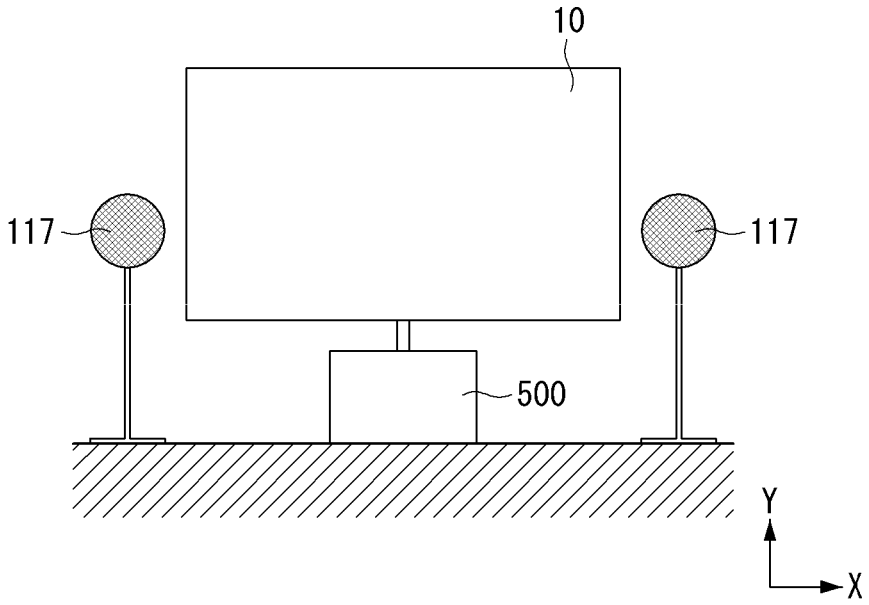

Referring to FIGS. 8A and 8B, the display device according to the embodiment may position speakers 117 on both sides of a front surface of the housing 500, respectively. The speaker 117 may output and transmit sound to the user. Hence, it may be more efficient to have the speakers 117 positioned on the front surface of the housing 500.

As shown in FIG. 8A, the speakers 117 may be separated from at least one PCB mounted inside the housing 500 and may be mounted on the front surface of the housing 500. Alternatively, as shown in FIG. 8B, the speakers 117 may be positioned to be separated from each other outside the housing 500. Because the speakers 117 are positioned outside the housing 500, the user may place or move the speakers 117 to a location where the sound may be satisfactorily transmitted to the user. The speakers 117 may be positioned on both sides of the body 10 of the display device. The display device may provide the speakers 117 on the front surface of the housing 500 or both sides outside the housing 500. Hence, the user may more satisfactorily receive the sound from the display device.

In the following description, the speaker 117 may mean a speaker assembly 400, or the speaker assembly 400 may be regarded as including the speaker 117. Both the speaker 117 and the speaker assembly 400 may be regarded as providing the sound.

Figure 9:
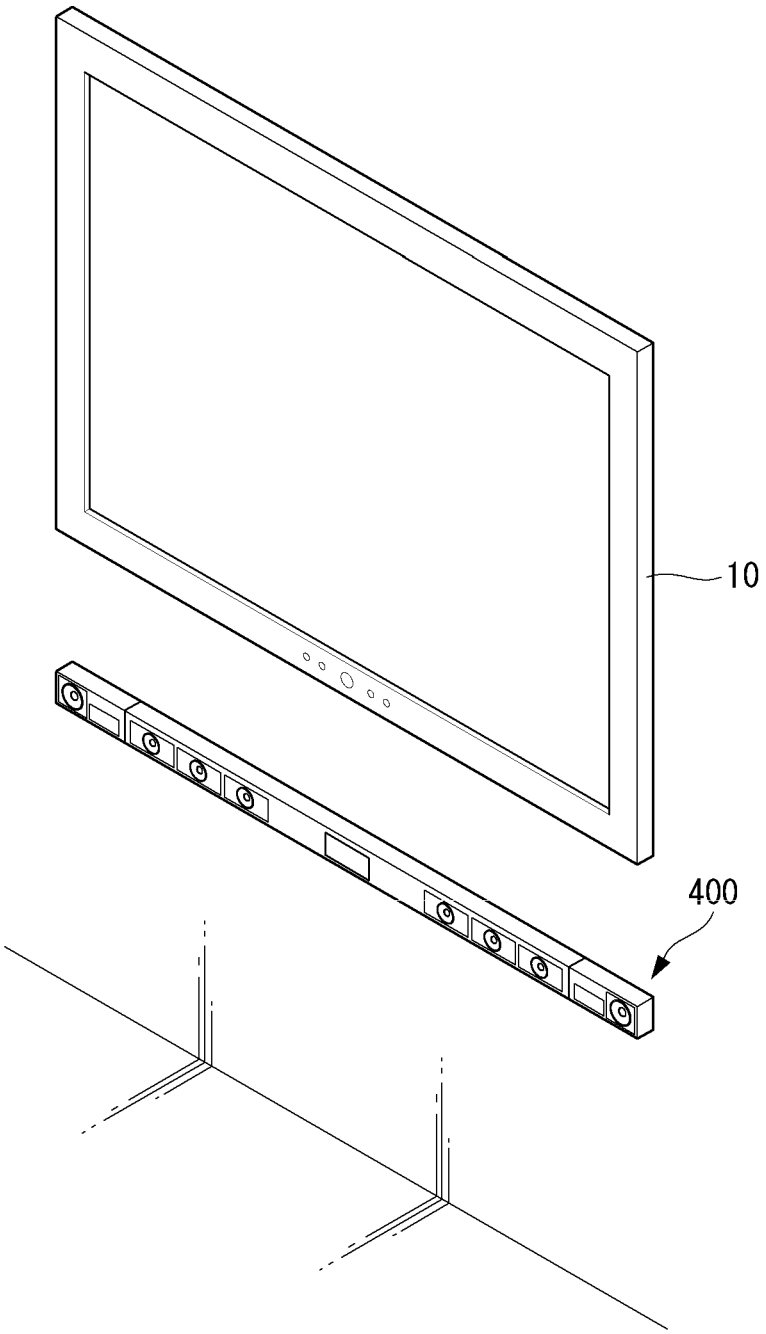
FIG. 9 is a view of a display device and a speaker assembly according to an embodiment.
Figure 10A:
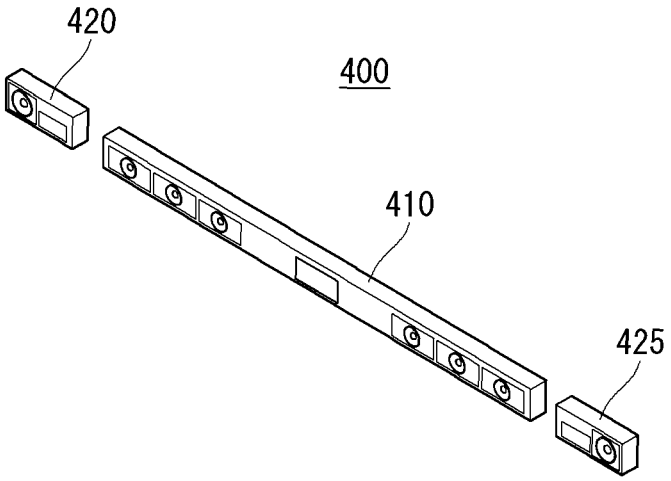
FIGS. 10A-10C are views of a speaker assembly according to an example embodiment.
Figure 10B:
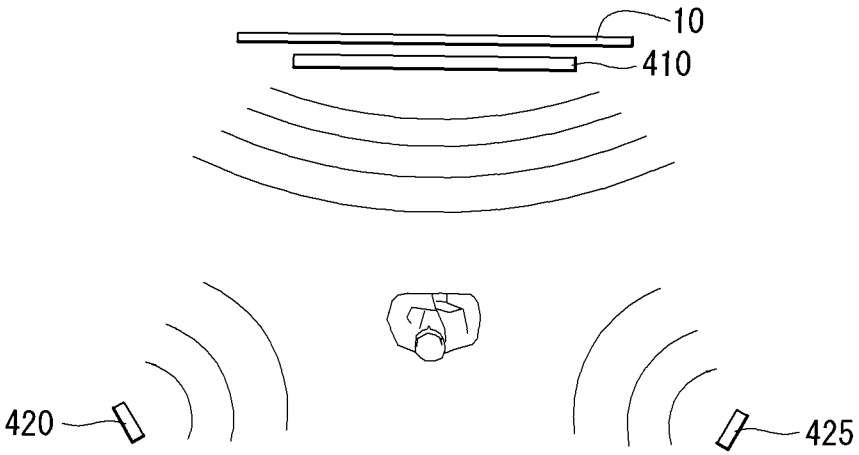
Figure 10C:
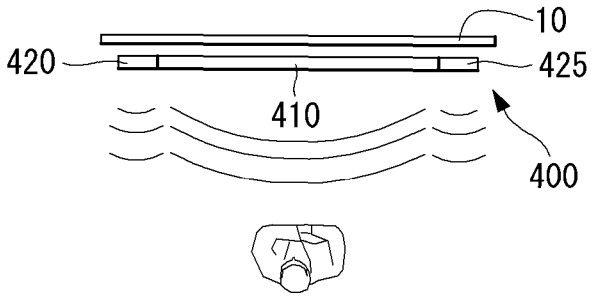

FIG. 9 is a view of a display device and a speaker assembly according to the embodiment. FIGS. 10A-10C are views of a speaker assembly according to the embodiment. Referring to FIGS. 9 and 10A, the speaker assembly 400 may be separated from the display device 10. The speaker assembly 400 may be connected to the display device 10 wirelessly or with wires. The display device 10 may include a separate speaker or may not include a speaker.

The speaker assembly 400 may include a speaker unit or speaker. The speaker assembly 400 may include a plurality of speaker units or speakers. For example, the speaker assembly 400 may include a first speaker unit providing a high frequency sound, a second speaker unit providing a medium frequency sound, and a third speaker unit providing a low frequency sound. The speaker assembly 400 may include a first speaker unit providing a high frequency sound and a second speaker unit providing a low frequency sound. The speaker assembly 400 may include three speaker units. A first speaker unit 410 may provide a high frequency sound and a low frequency sound. A second speaker unit 420 or a third speaker unit 425 may provide a low frequency sound. The second speaker unit 420 or the third speaker unit 425 may be used to improve a performance of the first speaker unit 410.

Referring to FIG. 10B, the second speaker unit 420 or the third speaker unit 425 may be positioned to be separated from the first speaker unit 410 by a predetermined distance to provide the sound. This is to provide a more improved sound for the user watching the display device 10. Thus, the speaker assembly 400 may provide a surround sound for the user.

Referring to FIG. 10C, the second speaker unit 420 or the third speaker unit 425 may be coupled with the first speaker unit 410 to provide the sound. This is to provide a more extended and improved sound for the user watching the display device 10. The speaker assembly 400 may further enhance the low frequency sound and then provide the enhanced low frequency sound to the user. Alternatively, the speaker assembly 400 may further enhance the medium/low frequency sound and then provide the enhanced medium/low frequency sound to the user.

Figure 11:
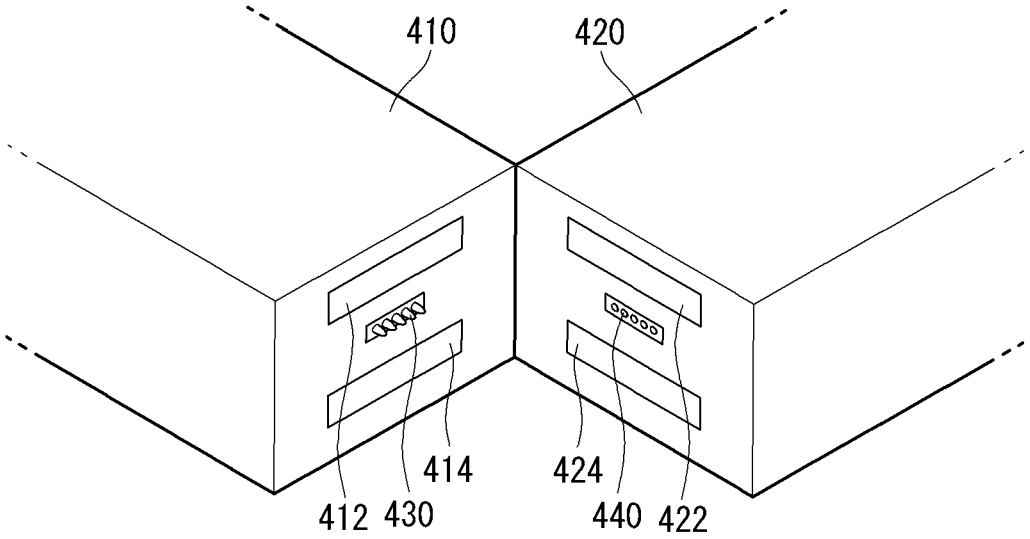
FIGS. 11 to 13 are views of coupling components of a speaker assembly according to an embodiment.

FIGS. 11 to 17 are views of coupling components of the speaker assembly according to the embodiment. Referring to FIG. 11, the first speaker unit 410 may be coupled with the second speaker unit 420 or may be separated from the second speaker unit 420. The first speaker unit 410 may include first magnetic bodies or magnets 412 and 414, and the second speaker unit 420 may include second magnetic bodies or magnets 422 and 424. The first magnetic bodies 412 and 414 may have a magnetic polarity different from the second magnetic bodies 422 and 424. For example, when the first magnetic bodies 412 and 414 have a magnetic polarity of N-pole, the second magnetic bodies 422 and 424 may have a magnetic polarity of S-pole. When the first magnetic bodies 412 and 414 have a magnetic polarity of S-pole, the second magnetic bodies 422 and 424 may have a magnetic polarity of N-pole. The first magnetic bodies 412 and 414 and/or the second magnetic bodies 422 and 424 may be a plurality of magnetic bodies. The plurality of first magnetic bodies 412 and 414 may have a magnetic polarity different from the plurality of second magnetic bodies 422 and 424.

The first magnetic bodies 412 and 414 may be positioned on a side of the first speaker unit 410. The first magnetic bodies 412 and 414 may be positioned inside the side of the first speaker unit 410. The first magnetic bodies 412 and 414 may be positioned outside the side of the first speaker unit 410. The first speaker unit 410 may include a first connector 430. The first connector 430 may be positioned on the side of the first speaker unit 410. For example, the first connector 430 may be a pogo pin. The plurality of first magnetic bodies 412 and 414 may be symmetric to each other with respect to the first connector 430. One of the plurality of first magnetic bodies 412 and 414, for example, 412, may be positioned on one side of the first connector 430, and another first magnetic body, for example, 414, may be positioned on another side of the first connector 430. The plurality of first magnetic bodies 412 and 414 may be positioned on the upper and lower sides or the left and right sides of the first connector 430.

The second magnetic bodies 422 and 424 may be positioned on the side of the second speaker unit 420. The second magnetic bodies 422 and 424 may be positioned inside the side of the second speaker unit 420. The second magnetic bodies 422 and 424 may be positioned outside the side of the second speaker unit 420. The second speaker unit 420 may include a second connector 440. The second connector 440 may be positioned on the side of the second speaker unit 420. For example, the second connector 440 may be a pogo pin. The plurality of second magnetic bodies 422 and 424 may be symmetric to each other with respect to the second connector 440. One of the plurality of second magnetic bodies 422 and 424, for example, 422, may be positioned on one side of the second connector 440, and another second magnetic body, for example, 424, may be positioned on another side of the second connector 440. The plurality of second magnetic bodies 422 and 424 may be positioned on upper and lower sides or left and right sides of the second connector 440. The second connector 440 may be inserted into the first connector 430. The first connector 430 may be inserted into the second connector 440. The first connector 430 and the second connector 440 may be electrically connected to each other. For example, the first connector 430 may be a male pogo pin, and the second connector 440 may be a female pogo pin. Hence, the first connector 430 and the second connector 440 may be solidly connected to each other.

Figure 12:
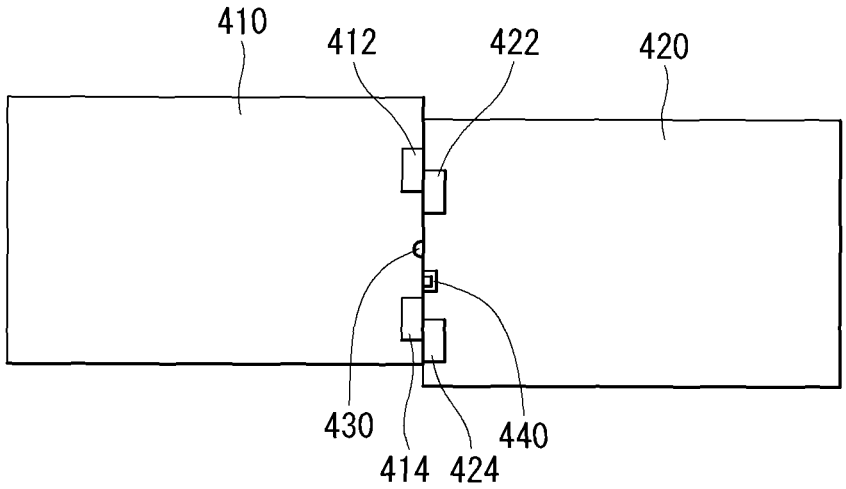

Referring to FIG. 12, the first speaker unit 410 may be coupled with the second speaker unit 420. In this instance, a coupling of the first speaker unit 410 and the second speaker unit 420 may be performed through a coupling of the first magnetic bodies 412 and 414 and the second magnetic bodies 422 and 424. When one side of the first speaker unit 410 is adjacent to one side of the second speaker unit 420, the first speaker unit 410 and the second speaker unit 420 may be coupled with each other by a magnetic force. The first magnetic bodies 412 and 414 and the second magnetic bodies 422 and 424 may contribute to the coupling of the first speaker unit 410 and the second speaker unit 420. However, it may be difficult for the first magnetic bodies 412 and 414 and the second magnetic bodies 422 and 424 to contribute to inserting the first connector 430 into the second connector 440. Thus, the first speaker unit 410 and the second speaker unit 420 may be misaligned.

Figure 13:
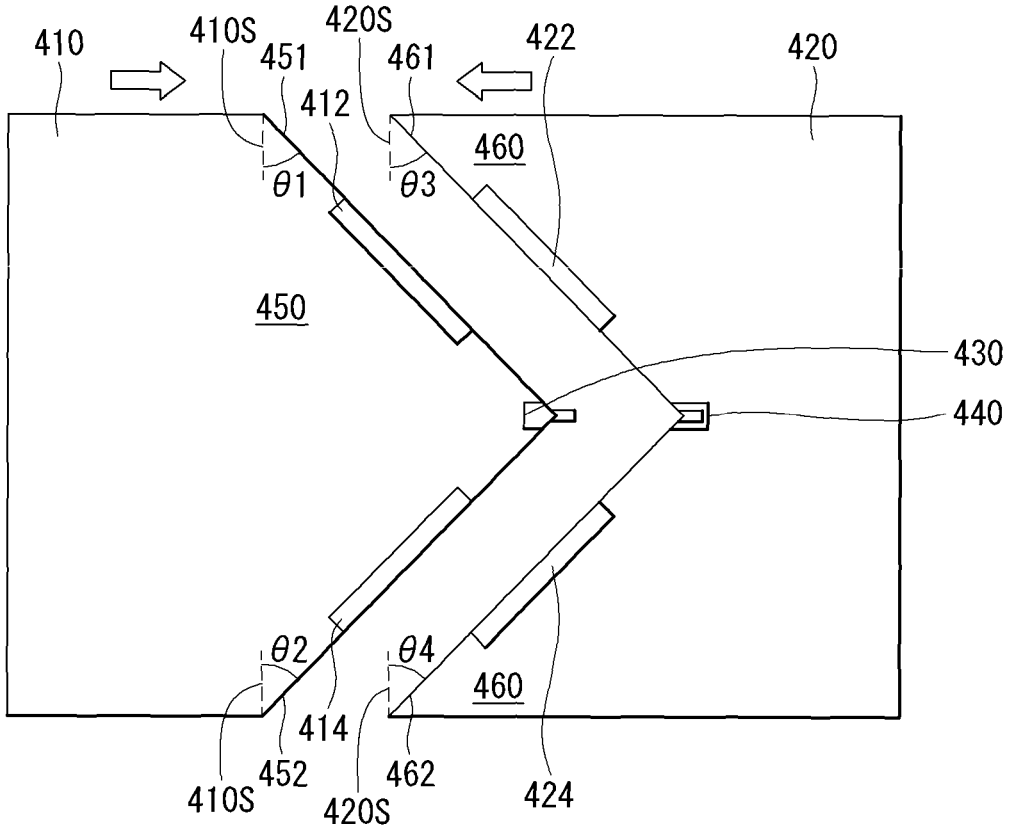

Referring to FIG. 13, the first speaker unit 410 may include a first connecting portion 450. The first connecting portion 450 may be formed on a side or a side surface of the first speaker unit 410. The first connecting portion 450 may protrude from the side or the side surface of the first speaker unit 410. The first connecting portion 450 may include a protrusion protruding out from the first speaker unit 410. The first connecting portion 450 may have a plurality of surfaces.

The first connecting portion 450 may have a first surface 451 and a second surface 452. The first surface 451 and the second surface 452 may meet each other. The first surface 451 and the second surface 452 may meet each other at one side. The first surface 451 and the second surface 452 may form a side or corner while meeting each other. Thus, the first connecting portion 450 may have a triangular shape or a triangular pyramid shape. The first connecting portion 450 may have the triangular shape with respect to a cross section of the first speaker unit 410. The protrusion of the first connecting portion 450 may have the first surface 451 and the second surface 452.

The first surface 451 may be inclined at a predetermined angle θ1. For example, the first surface 451 may be inclined from one side surface 410S of the first speaker unit 410 at the angle θ1 of 30° to 60°. The first surface 451 may be inclined from the side surface 410S of the first speaker unit 410 at the angle θ1 of 45°. The second surface 452 may be inclined at a predetermined angle θ2. For example, the second surface 452 may be inclined from one side surface 410S of the first speaker unit 410 at the angle θ2 of 30° to 60°. The second surface 452 may be inclined from the side surface 410S of the first speaker unit 410 at the angle θ2 of 45°.

As another example, the first connecting portion 450 may have the triangular pyramid shape or a poly-pyramid shape with respect to the side of the first speaker unit 410. In other words, the first connecting portion 450 may have a pyramid shape with respect to the side of the first speaker unit 410. The first connecting portion 450 may form a dome with respect to the side of the first speaker unit 410.

The first connector 430 may be positioned between the first surface 451 and the second surface 452. The first connector 430 may be positioned on the side formed by the first surface 451 and the second surface 452. The first connector 430 may be positioned at a tip of the first connecting portion 450. The first connector 430 may be positioned inside the first speaker unit 410. An end of the first connector 430 may be exposed to an outside of the first speaker unit 410 or an outside of the first connecting portion 450. In this instance, the end of the first connector 430 may be protruded and exposed to the outside of the first speaker unit 410 or the outside of the first connecting portion 450. For example, when the first connector 430 is the pogo pin, the pogo pin may protrude out from the first speaker unit 410 or from the first connecting portion 450.

The second speaker unit 420 may include a second connecting portion 460. The second connecting portion 460 may be formed on a side or a side surface of the second speaker unit 420. The second connecting portion 460 may be inwardly depressed at the side or the side surface of the second speaker unit 420. The second connecting portion 460 may include a depression depressed inward in the second speaker unit 420. The second connecting portion 460 may have a plurality of surfaces.

The second connecting portion 460 may have a first surface 461 and a second surface 462. The first surface 461 and the second surface 462 may meet each other. The first surface 461 and the second surface 462 may meet each other at one side. The first surface 461 and the second surface 462 may form one side while meeting each other. Thus, the second connecting portion 460 may entirely have a triangular shape or an intaglio triangular pyramid shape. The second connecting portion 460 may have the triangular shape with respect to a cross section of the second speaker unit 420. The depression of the second connecting portion 460 may have the first surface 461 and the second surface 462.

The first surface 461 may be inclined at a predetermined angle θ3. For example, the first surface 461 may be inclined from one side surface 420S of the second speaker unit 420 at the angle θ3 of 30° to 60°. The first surface 461 may be inclined from the side surface 420S of the second speaker unit 420 at the angle θ3 of 45°. The second surface 462 may be inclined at a predetermined angle θ4. For example, the second surface 462 may be inclined from one side surface 420S of the second speaker unit 420 at the angle θ4 of 30° to 60°. The second surface 462 may be inclined from the side surface 420S of the second speaker unit 420 at the angle θ4 of 45°.

As another example, the second connecting portion 460 may have the intaglio triangular pyramid shape or an intaglio poly-pyramid shape with respect to the side of the second speaker unit 420. In other words, the second connecting portion 460 may have an intaglio pyramid shape with respect to the side of the second speaker unit 420. The second connecting portion 460 may form a bowl shape with respect to the side of the second speaker unit 420.

The second connector 440 may be positioned between the first surface 461 and the second surface 462. The second connector 440 may be positioned on the side formed by the first surface 461 and the second surface 462. The second connector 440 may be positioned at a tip of the bottom of the second connecting portion 460. The second connector 440 may be positioned inside the second speaker unit 420 or the second connecting portion 460. An end of the second connector 440 may be exposed to an outside of the second speaker unit 420 or an outside of the second connecting portion 460. In this instance, the end of the second connector 440 may be protruded and exposed to the outside of the second speaker unit 420 or the outside of the second connecting portion 460. For example, when the first connector 430 and the second connector 440 are the pogo pin, a terminal of the second connector 440, into which the pin of the first connector 430 may be inserted, may be exposed to the outside of the second speaker unit 420 or the outside of the second connecting portion 460.

The first magnetic bodies 412 and 414 may be positioned at the first connecting portion 450. The first magnetic bodies 412 and 414 may be a plurality of magnetic bodies. One of the plurality of first magnetic bodies 412 and 414, (or example, 412, may be positioned on the first surface 451, and the other first magnetic body, for example, 414, may be positioned on the second surface 452. The first magnetic bodies 412 and 414 may be positioned inside or outside of the first connecting portion 450. The second magnetic bodies 422 and 424 may be positioned at the second connecting portion 460. The second magnetic bodies 422 and 424 may be in plural. One of the plurality of second magnetic bodies 422 and 424, for example, 422, may be positioned on the first surface 461, and other second magnetic body, for example, 424, may be positioned on the second surface 462. The second magnetic bodies 422 and 424 may be positioned inside or outside of the second connecting portion 460.

Figure 14:
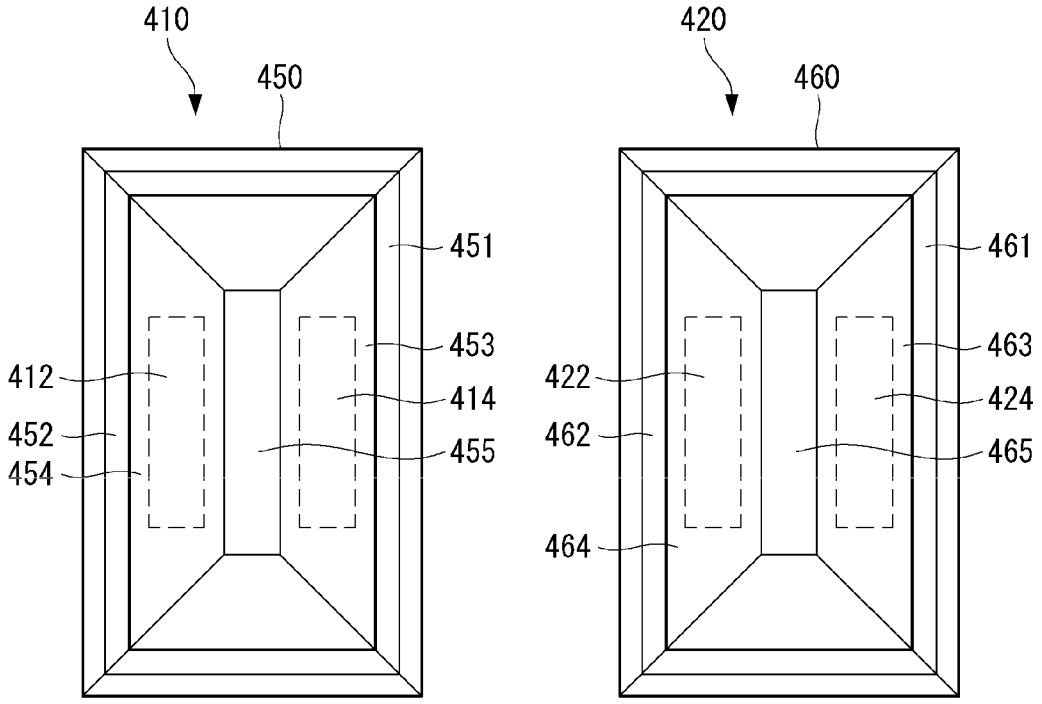
FIGS. 14 to 16 are views of a side of a speaker unit or speaker according to an embodiment.

FIG. 14 is a view of a side of a speaker unit according to the embodiment. The side of the speaker unit may be a side when viewed from the surfaces of the connecting portion. Referring to FIG. 14, the first magnetic bodies 412 and 414 may be positioned at the first connecting portion 450. The first magnetic bodies 412 and 414 may be positioned inside of the first connecting portion 450. The first magnetic bodies 412 and 414 may be positioned on a third surface 453 or a fourth surface 454. The first magnetic bodies 412 and 414 may be a plurality of magnetic bodies. One of the plurality of first magnetic bodies 412 and 414, for example, 414, may be positioned on the third surface 453, and the other first magnetic body, for example, 412, may be positioned on the fourth surface 454. The first magnetic body 414 and the first magnetic body 412 may be symmetric to each other with respect to a fifth surface 455.

The second magnetic bodies 422 and 424 may be positioned at the second connecting portion 460. The second magnetic bodies 422 and 424 may be positioned inside the second connecting portion 460. The second magnetic bodies 422 and 424 may be positioned on a third surface 463 or a fourth surface 464. The second magnetic bodies 422 and 424 may be a plurality of magnetic bodies. One of the plurality of second magnetic bodies 422 and 424, for example, 424, may be positioned on the third surface 463, and the other second magnetic body, for example, 422, may be positioned on the fourth surface 464. The second magnetic body 424 and the second magnetic body 422 may be symmetric to each other with respect to a fifth surface 465. For example, the first magnetic body 412 may be a S-pole, and the second magnetic body 424 may be a N-pole. Further, the first magnetic body 414 may be a S-pole, and the second magnetic body 422 may be a N-pole.

Figure 15:
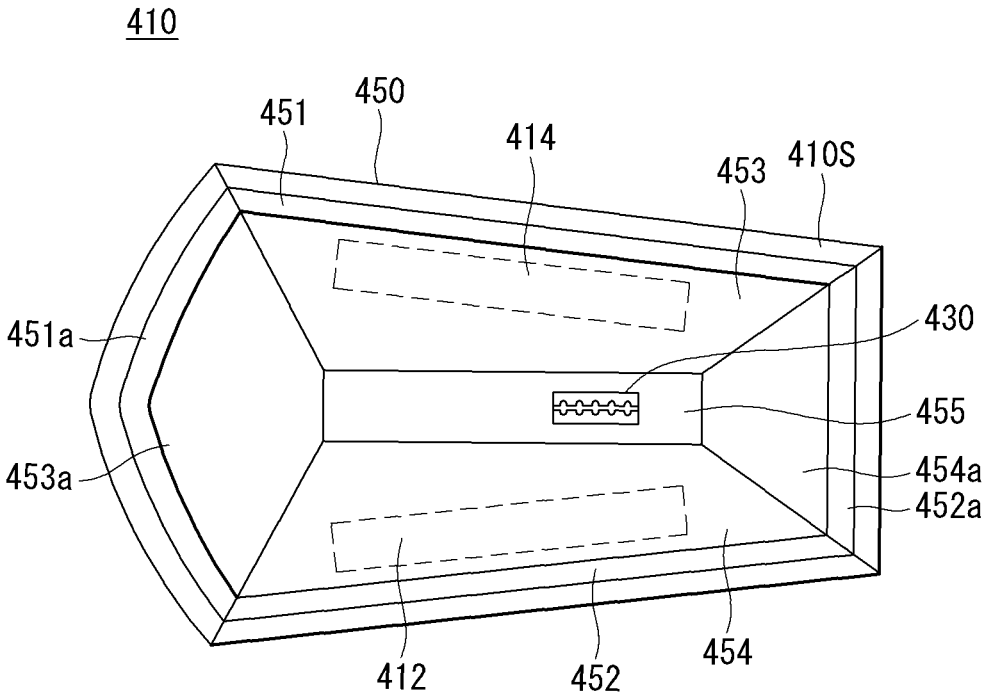
Figure 16:
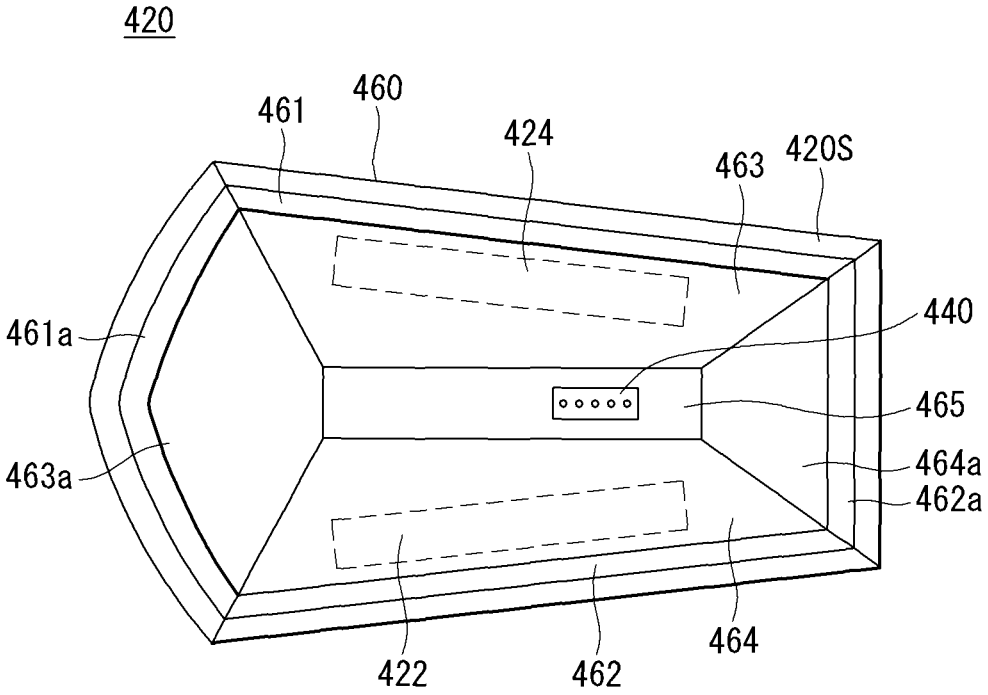

FIGS. 15 and 16 are views of a side of a speaker unit according to the embodiment. Referring to FIG. 15, one side surface 410S of the first speaker unit 410 may be positioned at the outside of the first connecting portion 450. The one side surface 410S of the first speaker unit 410 may form the outside of the first connecting portion 450. In this instance, the outside may be an edge of the first connecting portion 450. A first surface 451 may start from the edge of the first connecting portion 450. A second surface 452 may start from the edge of the first connecting portion 450. The first surface 451 and the second surface 452 may be symmetric to each other with respect to a fifth surface 455. The first surface 451 or the second surface 452 may protrude from the edge of the first connecting portion 450 to the outside of the first speaker unit 410 at an inclination.

A third surface 453 may start from the first surface 451 and may extend to the fifth surface 455. A fourth surface 454 may start from the second surface 452 and may extend to the fifth surface 455. The third surface 453 and the fourth surface 454 may be symmetric to each other with respect to the fifth surface 455. The third surface 453 or the fourth surface 454 may be depressed to the inside of the first speaker unit 410 at an inclination. The fifth surface 455 may form a bottom. The configuration of the first surface 451 or the second surface 452 may be applied to a seventh surface 451*a* and an eighth surface 452*a*. The configuration of the third surface 453 or the fourth surface 454 may be applied to a ninth surface 453*a* and a tenth surface 454*a*.

The first surface 451, the second surface 452, the seventh surface 451*a*, and the eighth surface 452*a* may form a ring-shaped perimeter of the first connecting portion 450. The first surface 451, the second surface 452, the seventh surface 451*a*, and the eighth surface 452*a* may form an angular pipe line at the perimeter of the first connecting portion 450. The first surface 451, the second surface 452, the seventh surface 451*a*, and the eighth surface 452*a* may form a male thread shape of screw at the perimeter of the first connecting portion 450.

The third surface 453, the fourth surface 454, the ninth surface 453*a*, and the tenth surface 454*a* may form a sunken area in a middle of the first connecting portion 450. The third surface 453, the fourth surface 454, the ninth surface 453*a*, and the tenth surface 454*a* may form a downwardly depressed area in the middle of the first connecting portion 450. The fifth surface 455 may firm a bottom of the sunken area or the downwardly depressed area. The sunken area may be referred to as a sunken surface. In other words, the first connecting portion 450 may include the first to tenth surfaces 451 to 454*a*. Hence, the first connecting portion 450 may protrude from the edge of the first speaker unit 410 toward the outside of the first speaker unit 410 at an inclination and may be again depressed toward the inside of the first speaker unit 410 at an inclination. The first connecting portion 450 may have a crater shape.

Referring to FIG. 16, one side surface 420S of the second speaker unit 420 may be positioned at the outside of the second connecting portion 460. The one side surface 420S of the second speaker unit 420 may form the outside of the second connecting portion 460. In this instance, the outside may be an edge of the second connecting portion 460. A first surface 461 may start from the edge of the second connecting portion 460. A second surface 462 may start from the edge of the second connecting portion 460. The first surface 461 and the second surface 462 may be symmetric to each other with respect to a fifth surface 465. The first surface 461 or the second surface 462 may be depressed from the edge of the second connecting portion 460 to an inside of the second speaker unit 420 at an inclination.

A third surface 463 may start from the first surface 461 and may extend to the fifth surface 465. A fourth surface 464 may start from the second surface 462 and may extend to the fifth surface 465. The third surface 463 and the fourth surface 464 may be symmetric to each other with respect to the fifth surface 465. The third surface 463 or the fourth surface 464 may protrude to the outside of the second speaker unit 420 at an inclination. The fifth surface 465 may form a summit. The configuration of the first surface 461 or the second surface 462 may be applied to a seventh surface 461*a* and an eighth surface 462*a*. The configuration of the third surface 463 or the fourth surface 464 may be applied to a ninth surface 463*a* and a tenth surface 464*a*.

The first surface 461, the second surface 462, the seventh surface 461*a*, and the eighth surface 462*a* may form a ring-shaped perimeter of the second connecting portion 460. The first surface 461, the second surface 462, the seventh surface 461*a*, and the eighth surface 462*a* may form a depressed pipe line at the perimeter of the second connecting portion 460. The first surface 461, the second surface 462, the seventh surface 461*a*, and the eighth surface 462*a* may form a female thread shape of screw at the perimeter of the second connecting portion 460.

The third surface 463, the fourth surface 464, the ninth surface 463*a*, and the tenth surface 464*a* may form an uplifted area in a middle of the second connecting portion 460. The third surface 463, the fourth surface 464, the ninth surface 463*a*, and the tenth surface 464*a* may form a protruded area in the middle of the second connecting portion 460. The fifth surface 465 may firm an upper surface of the uplifted area or the protruded area. The uplifted area may be referred to as an uplifted surface. In other words, the second connecting portion 460 may include the first to tenth surfaces 461 to 464*a*. Hence, the second connecting portion 460 may be depressed from the outside of the second speaker unit 420 toward the inside of the second speaker unit 420 at an inclination and may again protrude toward the outside of the second speaker unit 420 at an inclination. The second connecting portion 460 may entirely have a dome shape.

Figure 17:
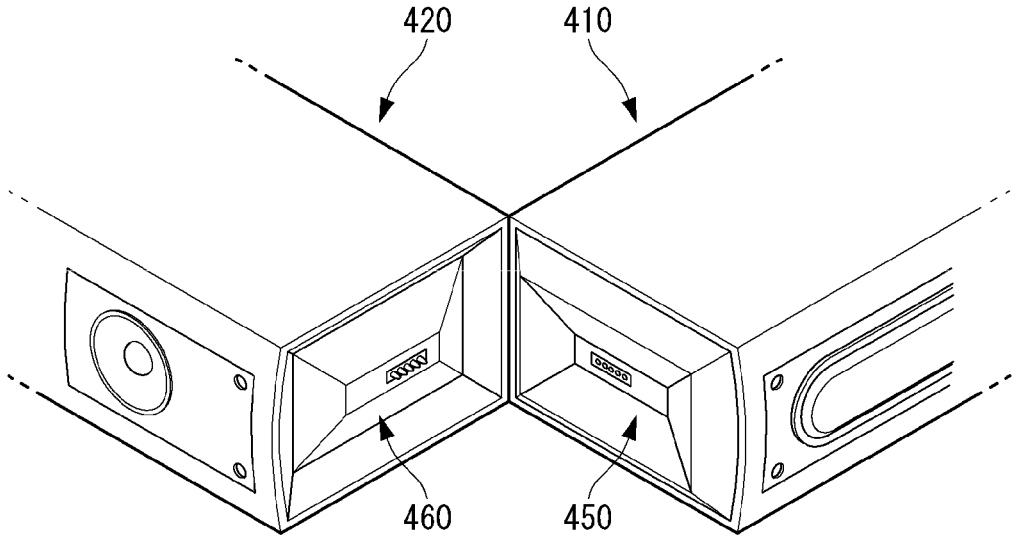
FIGS. 17 and 18 are views of coupling components of a speaker assembly according to an embodiment.
Figure 18:
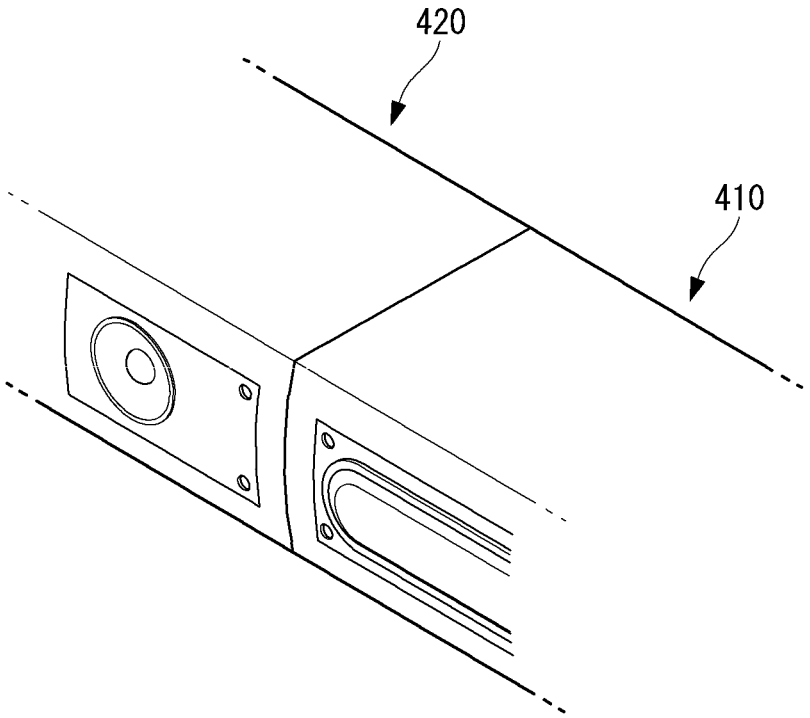

FIGS. 17 and 18 are views of coupling components of the speaker assembly according to the embodiment. An entire shape of the first connecting portion 450 may correspond to an entire shape of the second connecting portion 460. The entire shape of the first connecting portion 450 may match the entire shape of the second connecting portion 460, like a relationship between male and female threads. Hence, a coupling between the first speaker unit 410 and the second speaker unit 420 may be easily performed at an exact location.

Figure 19:
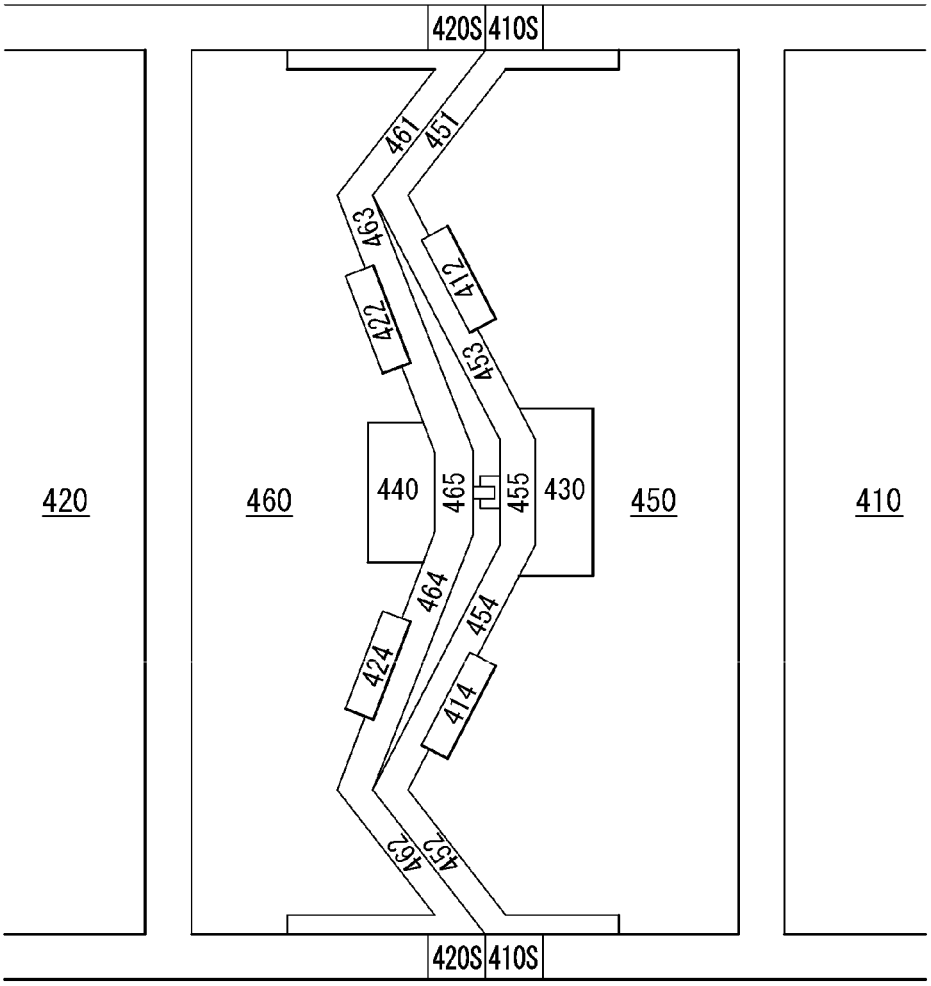
FIGS. 19 to 21 are views of a cross section of a speaker assembly according to an embodiment.
Figure 20:
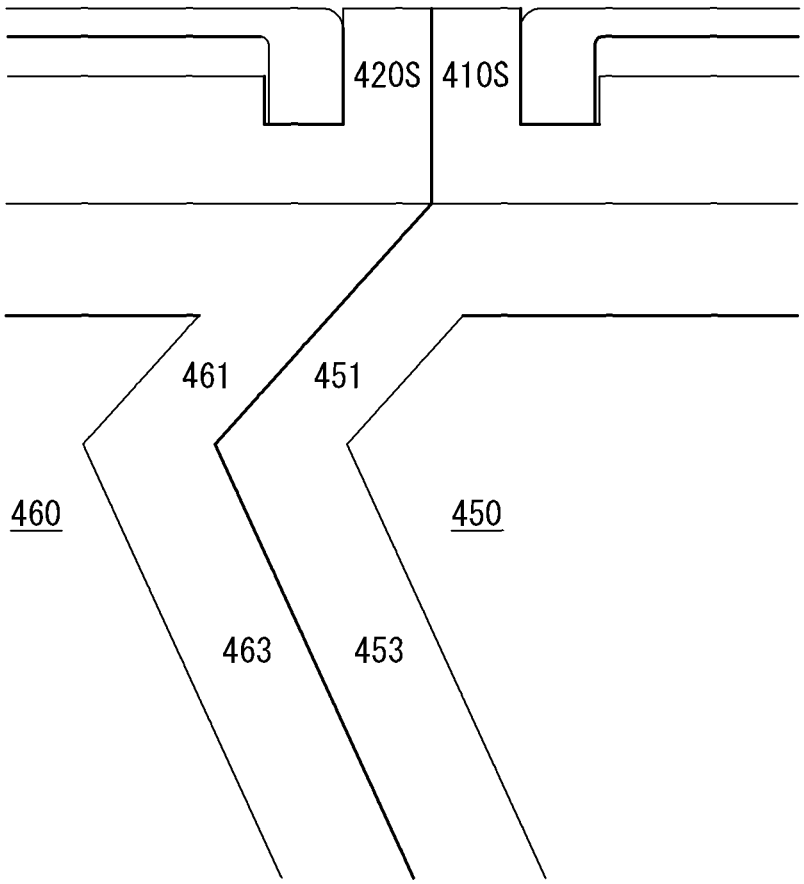
Figure 21:
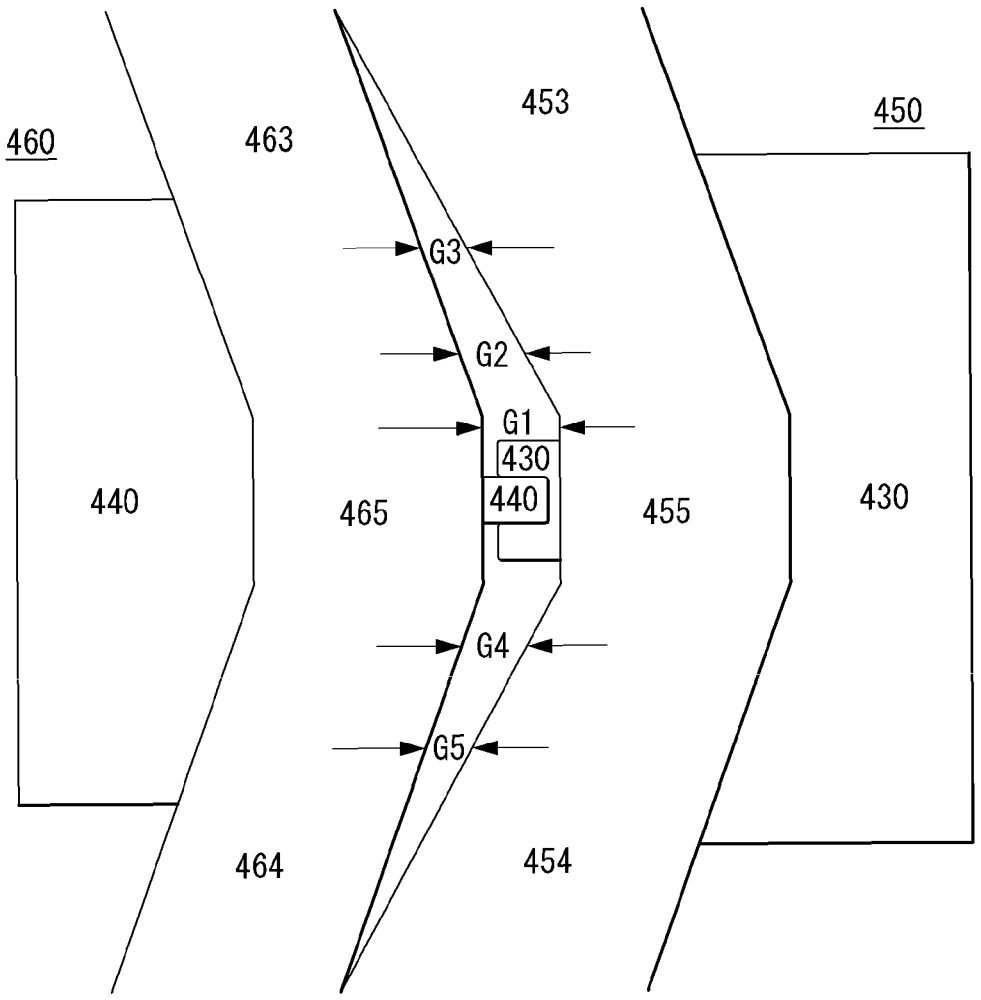

FIGS. 19 to 21 are views of a cross section of the speaker assembly according to the embodiment. Referring to FIGS. 19 and 20, when the first connecting portion 450 is inserted into the second connecting portion 460, the first surface 461 and/or the third surface 463 of the second connecting portion 460 may guide the first surface 451 and/or the third surface 453 of the first connecting portion 450. Hence, the first connecting portion 450 may face the second connecting portion 460. The first connecting portion 450 may contact the second connecting portion 460. The first surface 451 of the first connecting portion 450 may contact the first surface 461 of the second connecting portion 460. A portion of the third surface 453 of the first connecting portion 450 may contact a portion of the third surface 463 of the second connecting portion 460. The first speaker unit 410 may be accurately aligned and coupled with the second speaker unit 420.

Referring to FIGS. 19 and 21, as the first connecting portion 450 is inserted into the second connecting portion 460, the second connector 440 may be inserted into the first connector 430. Coupling the first connecting portion 450 and the second connecting portion 460 may be applied so that the second connector 440 is properly and accurately inserted into the first connector 430 without damage. In FIGS. 19 and 21, a portion of the third surface 453 of the first connecting portion 450 may be separated from a portion of the third surface 463 of the second connecting portion 460. The fifth surface 455 of the first connecting portion 450 may be separated from the fifth surface 465 of the second connecting portion 460. The first connecting portion 450 may be separated from the second connecting portion 460 by a predetermined distance. The predetermined distance may be uniform or non-uniform.

For example, the fifth surface 455 of the first connecting portion 450 may be separated from the fifth surface 465 of the second connecting portion 460 by a first distance G1. A portion of the third surface 453 of the first connecting portion 450 may be separated from a portion of the third surface 463 of the second connecting portion 460 by a second distance G2 or a third distance G3. The second distance G2 may be less than the third distance G3. A portion of the fourth surface 454 of the first connecting portion 450 may be separated from a portion of the fourth surface 464 of the second connecting portion 460 by a fourth distance G4 or a fifth distance G5. The fourth distance G4 may be greater than the fifth distance G5. The distance G may indicate a depth in terms of the depressed area and the sunken area. The distance G may indicate a height in terms of the protruded area and the uplifted area. Hence, the first connector 430 and/or the second connector 440 may be prevented from being damaged when the first speaker unit 410 is coupled with the second speaker unit 420.

Figure 22:
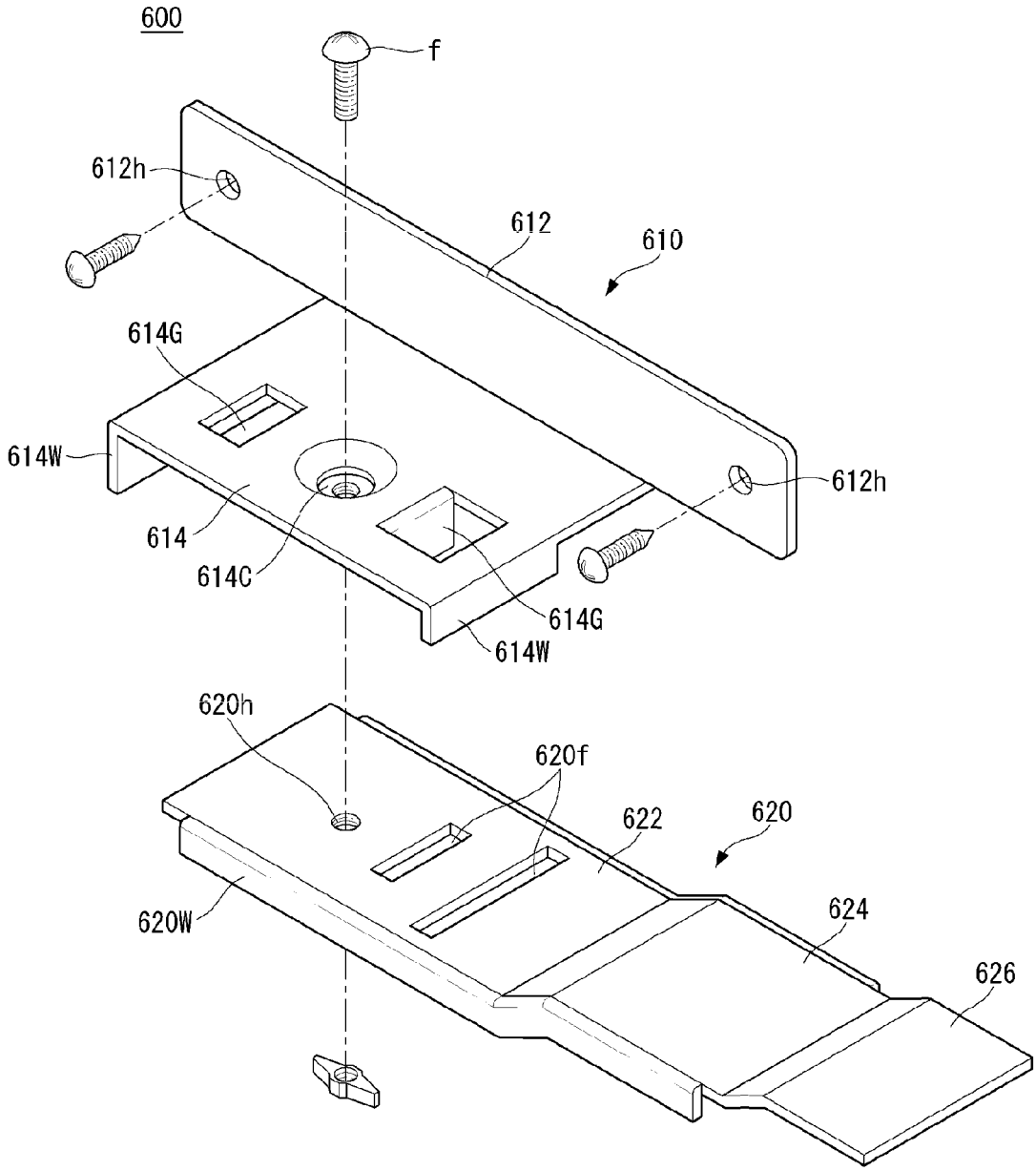
FIGS. 22 to 35 are views of a supporting structure of a speaker assembly according to an embodiment.

FIGS. 22 to 26 are views of a supporting structure of a speaker assembly according to the embodiment. Referring to FIG. 22, a first bracket 610 may be fixed to the outside of the speaker assembly, and a second bracket 620 may be connected to the first bracket 610. The second bracket 620 may rotate with respect to the first bracket 610. The first bracket 610 may include a fixing portion 612 and a supporting portion 614. The fixing portion 612 may have a plate shape. For example, the fixing portion 612 may be flat so as to face a wall surface. The fixing portion 612 may have a hole 612*h*. The hole 612*h* may be a plurality of holes. In other embodiments, the fixing portion 612 may not have the hole 612*h*.

The supporting portion 614 may be connected to the fixing portion 612. The supporting portion 614 may extend from the fixing portion 612. The supporting portion 614 may be formed while bending from the fixing portion 612. The supporting portion 614 may form one body along with the fixing portion 612 and may bend from the fixing portion 612. Alternatively, the supporting portion 614 may be formed separately from the fixing portion 612 and may be welded to the fixing portion 612. Various methods may be used to connect the supporting portion 614 to the fixing portion 612. The supporting portion 614 may bend from the fixing portion 612 at an angle close to a right angle. When the fixing portion 612 is fixed to the wall surface, the supporting portion 614 may be parallel to a vertical line direction of the wall surface. The supporting portion 614 may provide a predetermined supporting force in the opposite direction of gravity. The supporting portion 614 may support a portion of the speaker assembly 400. For example, the supporting portion 614 may support the first speaker unit 410 or the second speaker unit 420. The supporting portion 614 may have a plate shape.

The supporting portion 614 may have a wall 614W on one side or both sides. The wall 614W may form one body along with the supporting portion 614. Alternatively, the wall 614W may be formed separately from the supporting portion 614 and fixed to the supporting portion 614. The wall 614W may improve flexural rigidity of the supporting portion 614. The wall 614W may be formed along one side of the supporting portion 614 from the fixing portion 612. The supporting portion 614 and the wall 614W may be entirely formed in ⊓-shape, ⊔-shape, or ⊏-shape.

The supporting portion 614 may have a rotation center 614C. The rotation center 614C may be formed in a portion of the supporting portion 614. The rotation center 614C may be the center, around which the second bracket 620 rotates. The rotation center 614C may be formed by perforating a portion of the supporting portion 614. The rotation center 614C may protrude from the portion of the supporting portion 614. The rotation center 614C may be depressed in the portion of the supporting portion 614. The supporting portion 614 may include a rotation guide 614G. The rotation guide 614G may be positioned adjacent to the rotation center 614C. One rotation guide 614G or a plurality of rotation guides 614G may be formed around the rotation center 614C. When the second bracket 620 rotates around the rotation center 614C, the rotation guide 614G may maintain a predetermined distance between the first bracket 610 and the second bracket 620. The rotation guide 614G may be formed by perforating a portion of the supporting portion 614. The rotation guide 614G may be formed by bending the portion of the supporting portion 614. The rotation guide 614G may be formed by pressing the portion of the supporting portion 614. The rotation guide 614G may be formed by protruding the portion of the supporting portion 614.

The second bracket 620 may be rotatably connected to the first bracket 610. The second bracket 620 may be connected to the rotation center 614C of the first bracket 610. The second bracket 620 may rotate around the rotation center 614C of the first bracket 610. The second bracket 620 may include a rotating portion 622, a supporting portion 624, and a hanging portion 626. The rotating portion 622 may be connected to the first bracket 610. The rotating portion 622 may be connected to the rotation center 614C of the first bracket 610. The rotating portion 622 may have a plate shape. The rotating portion 622 may have a rotation hole 620*h*. The rotation hole 620*h* may be connected to the rotation center 614C of the first bracket 610. A coupling member f may pass through the rotation hole 620*h* and the rotation center 614C. For example, the coupling member f may be a bolt and a nut. Alternatively, the coupling member f may be a rivet. The rotating portion 622 may have a fixing groove 620*f*. The fixing groove 620*f* may be formed in a portion of the rotating portion 622. The fixing groove 620*f* may be formed to extend in the portion of the rotating portion 622. A portion of the wall 614W or a portion of the rotation guide 614G in the first bracket 610 may be inserted into the fixing groove 620*f*. As the second bracket 620 rotates around the rotation center 614C of the first bracket 610, the wall 614W or the rotation guide 614G of the first bracket 610 may be inserted into the fixing groove 620*f* of the second bracket 620. Hence, the second bracket 620 may stop rotating. As a result, the first speaker unit 410 or the second speaker unit 420 may be supported by the second bracket 620, and at the same time the support of the first speaker unit 410 or the second speaker unit 420 may restrict the rotation of the second bracket 620.

The supporting portion 624 may be connected to the rotating portion 622. The supporting portion 624 may extend from the rotating portion 622. The supporting portion 624 may extend from the rotating portion 622 while forming a height difference between the rotating portion 622 and the supporting portion 624. The supporting portion 624 may extend from the rotating portion 622 while forming a large height difference between the rotating portion 622 and the supporting portion 624. The supporting portion 624 may support the first speaker unit 410 or the second speaker unit 420. The rotating portion 622 and/or the supporting portion 624 may include a wall 620W on one side or both sides. The wall 620W may be formed on one side or both sides of the rotating portion 622 or the supporting portion 624 and may be formed on one side or both sides of the rotating portion 622 and the supporting portion 624. Hence, flexural rigidity of the second bracket 620 may be improved.

The hanging portion 626 may be connected to the supporting portion 624. The hanging portion 626 may extend from the supporting portion 624. The hanging portion 626 may extend from the supporting portion 624 while forming a height difference between the supporting portion 624 and the hanging portion 626. The hanging portion 626 may extend from the supporting portion 624 while forming a large height difference between the supporting portion 624 and the hanging portion 626. The rotating portion 622, the supporting portion 624, and the hanging portion 626 may form a stepped shape. The hanging portion 626 may be inserted into a portion of the first speaker unit 410 or the second speaker unit 420.

Figure 23:
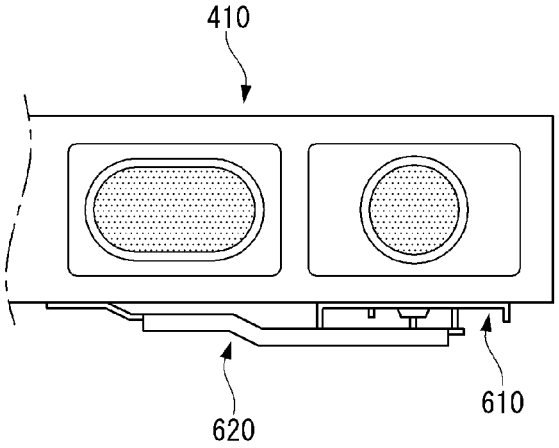

Referring to FIG. 23, the first bracket 610 may support the first speaker unit 410. The first speaker unit 410 may be placed on the first bracket 610. In this instance, the second bracket 620 may be positioned under the first bracket 610. In other words, the second bracket 620 may overlap the first bracket 610.

Figure 24:
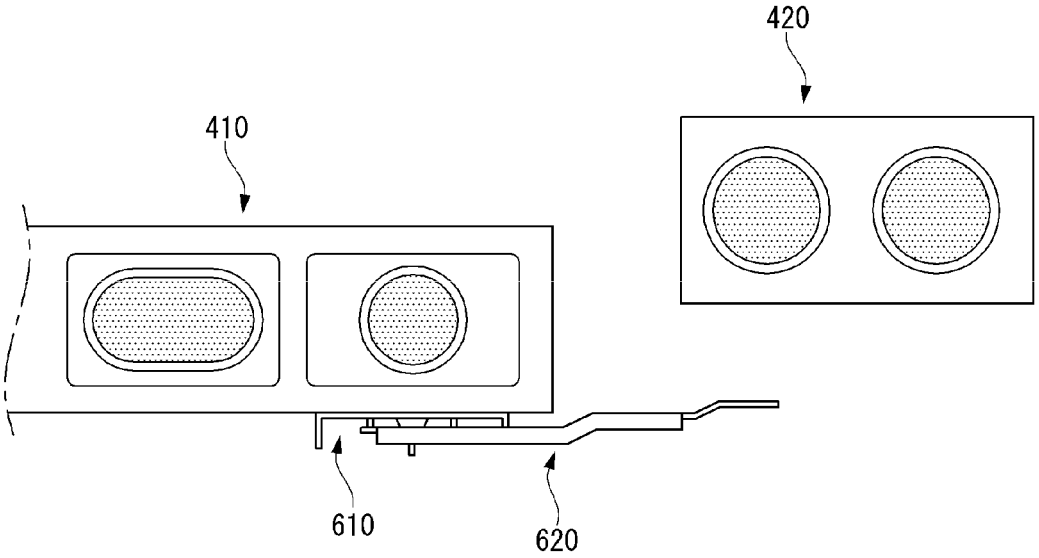

Referring to FIG. 24, the second bracket 620 may rotate around the first bracket 610. The second bracket 620 may rotate around the first bracket 610 and may be positioned on one side of the first bracket 610. The second bracket 620 may be spread or extend to one side of the first bracket 610. The second bracket 620 may provide the expandability capable of supporting the first speaker unit 410 or the second speaker unit 420 on one side of the first bracket 610.

Figure 25:
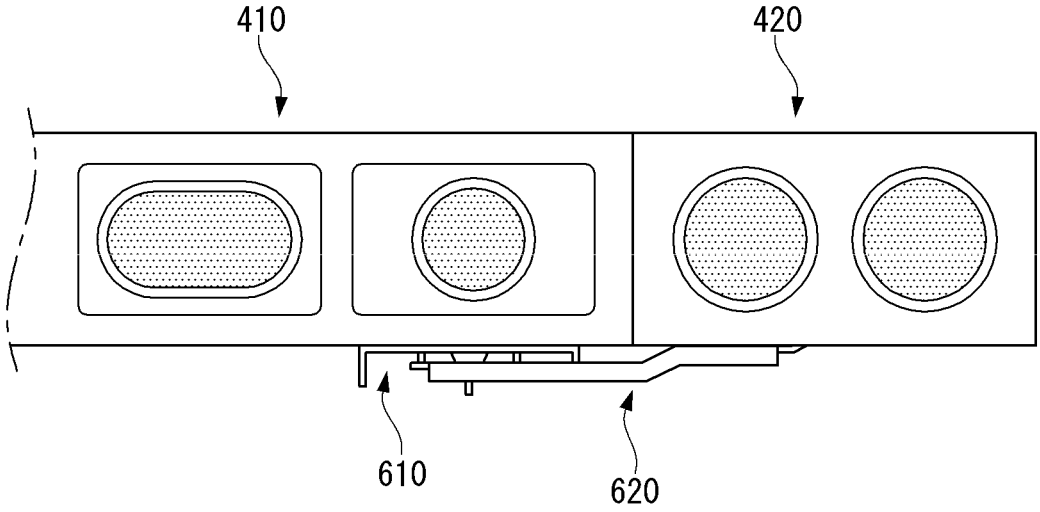

Referring to FIG. 25, the second speaker unit 420 may be placed on the second bracket 620. The second bracket 620 may support the second speaker unit 420. In this instance, the second speaker unit 420 may be coupled with the first speaker unit 410. The second bracket 620 may stably support the second speaker unit 420 coupled with the first speaker unit 410. The second speaker unit 420 may be coupled with the first speaker unit 410 by a magnetic force. Further, even if an external force or an external impact is applied to the first speaker unit 410 or the second speaker unit 420, coupling of the first speaker unit 410 and the second speaker unit 420 may be maintained.

Figure 26A:
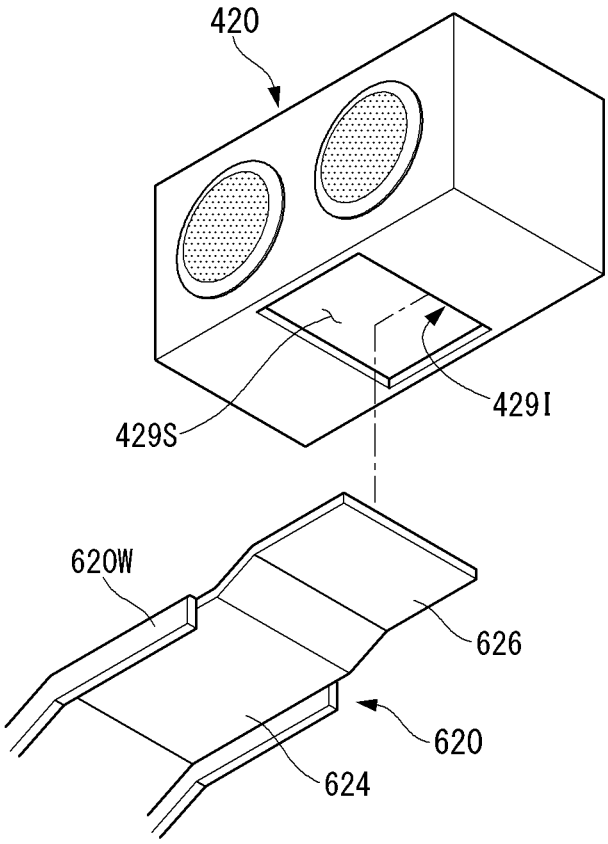
Figure 26B:
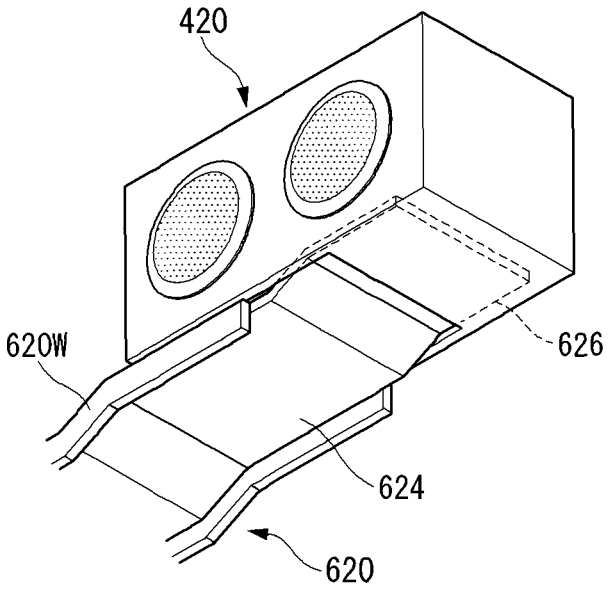

Referring to FIGS. 26A and 26B, the hanging portion 626 of the second bracket 620 may be inserted into a lower part or area of the second speaker unit 420. The second speaker unit 420 may have a fixing groove 429 at the lower part of the second speaker unit 420. The fixing groove 429 may be depressed towards an inside of the second speaker unit 420 so that the hanging portion 626 may be inserted into the fixing groove 429.

The second speaker unit 420 may include a stepped portion 429S and an insertion portion 429I. The stepped portion 429S may be formed at the lower part of the second speaker unit 420. The stepped portion 429S may be stepped down from the lower surface of the second speaker unit 420 to the inside of the second speaker unit 420. The insertion portion 429I may be connected to the stepped portion 429S. The insertion portion 429I may be dug or carved from one side of the stepped portion 429S to the inside of the second speaker unit 420. One side of the insertion portion 429I may be opened and remaining sides may be closed. The stepped portion 429S and the insertion portion 429I may form the fixing groove 429.

The hanging portion 626 may be inserted into the insertion portion 429I through the stepped portion 429S. When the hanging portion 626 is inserted into the fixing groove 429, the second speaker unit 420 may be placed on the second bracket 620. When the second speaker unit 420 is coupled with the first speaker unit 410 by the magnetic force, the second bracket 620 may support the second speaker unit 420 and may provide expandable support for the speaker assembly. The coupling of the first speaker unit 410 and the second speaker unit 420 may be maintained in spite of the external force or the external impact applied to the first speaker unit 410 and the second speaker unit 420.

Figure 27:
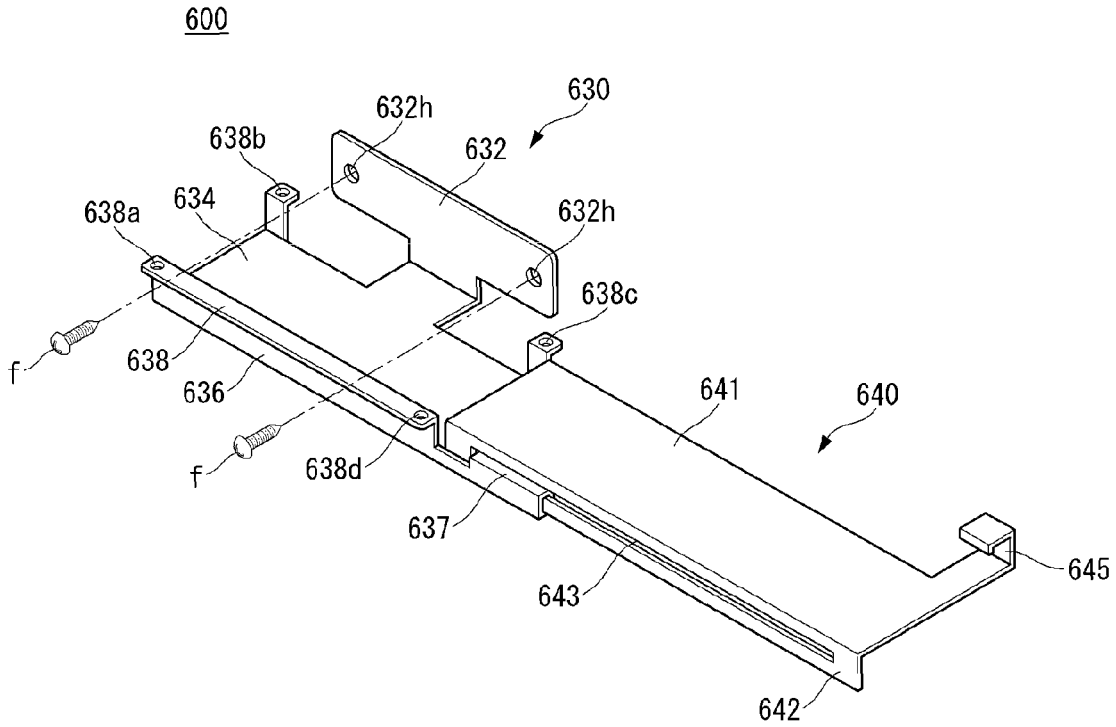
Figure 28:
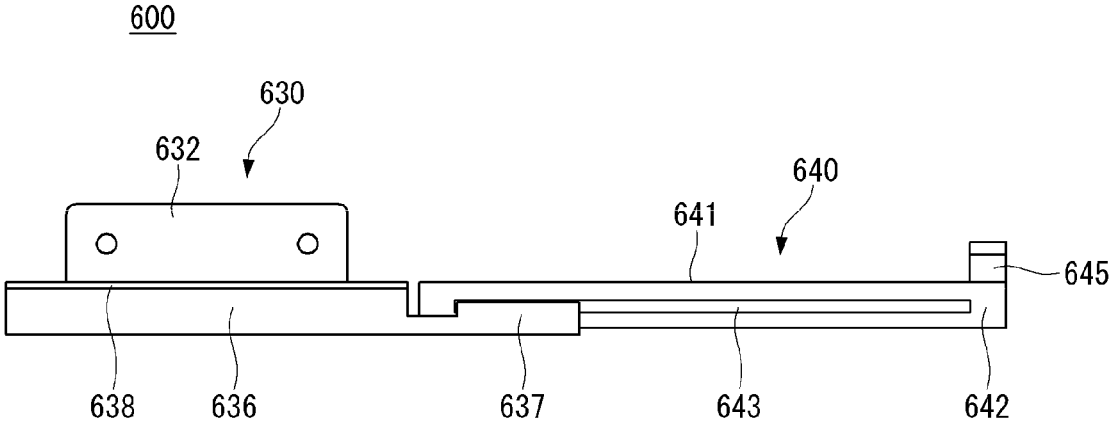

FIGS. 27 and 28 are views of another embodiment of the supporting structure of the speaker assembly. A first bracket 630 may slide from a second bracket 640. Alternatively, the second bracket 640 may slide from the first bracket 630. The second bracket 640 may be extended or expanded from the first bracket 630 in a longitudinal direction. The first bracket 630 may include a fixing portion 632. The fixing portion 632 may have a plate shape. The fixing portion 632 may be fixed to, for example, a wall surface through a coupling member f and a hole 632*h*. The coupling member f and the hole 632*h* may be omitted in the first bracket 630 in accordance with a fixing structure of the first bracket 630. The first bracket 630 may include a bottom 634. The bottom 634 may be connected to the fixing portion 632. The bottom 634 may extend from the fixing portion 632. The bottom 634 may form one body along with the fixing portion 632. Alternatively, the bottom 634 may be formed separately from the fixing portion 632 and welded to the fixing portion 632. The bottom 634 may be formed by bending from the fixing portion 632. The bottom 634 may be formed by pressing the bottom 634 and the fixing portion 632 together. The bottom 634 may provide a predetermined supporting force in the opposite direction of gravity.

The first bracket 630 may include a supporting portion 638. The supporting portion 638 may be connected to the bottom 634. The supporting portion 638 may extend from the bottom 634. The supporting portion 638 may extend from one side of the bottom 634. A plurality of supporting portions 638*a*, 638*b*, 638*c*, and 638*d* may extend from a corner of the bottom 634. The plurality of supporting portions 638 may be formed on the bottom 634. The first bracket 630 may have a side wall 636. The side wall 636 may be positioned between the bottom 634 and the supporting portion 638. The side wall 636 may be formed on one side of the bottom 634, and the supporting portion 638 may be formed on an upper side of the side wall 636. The supporting portion 638 may support the first speaker unit 410 or the second speaker unit 420. The first bracket 630 may include a slider 637. The slider 637 may be formed on one side of the bottom 634. The slider 637 may be formed by bending the bottom 634. The slider 637 may entirely have ⊏-shape. The slider 637 may be formed on both sides of the first bracket 630. The slider 637 may be provided along a longitudinal direction of the first bracket 630.

The second bracket 640 may include a supporting portion 641. The supporting portion 641 may form a plane of the second bracket 640. The supporting portion 641 may support the first speaker unit 410 or the second speaker unit 420. The supporting portion 641 may be flat. The supporting portion 641 may elongate along a longitudinal direction of the second bracket 640. The second bracket 640 may have a side wall 642. The side wall 642 may be formed on one side or both sides of the supporting portion 641. The side wall 642 may be formed by downwardly bending from the supporting portion 641. The second bracket 640 may include a rail 643. The rail 643 may be formed on the side wall 642. The rail 643 may have an engraved shape. The side wall 642 may be opened along the longitudinal direction and thus may form the rail 643.

The slider 637 of the first bracket 630 may be inserted into the rail 643 of the second bracket 640. When the second bracket 640 moves along the longitudinal direction of the first bracket 630, the slider 637 may guide a movement of the second bracket 640 while sliding on the rail 643. Thus, the second bracket 640 may be inserted into an inside of the first bracket 630 or may extend to an outside of the first bracket 630. When the second bracket 640 is inserted into the inside of the first bracket 630, the supporting portion 638 of the first bracket 630 and the supporting portion 641 of the second bracket 640 may support the first speaker unit 410. Further, when the second bracket 640 extends to the outside of the first bracket 630, the supporting portion 638 of the first bracket 630 may support the first speaker unit 410, and the supporting portion 641 of the second bracket 640 may support the second speaker unit 420. Hence, the first and second bracket 630 and 640 may provide an expandable support of the speaker assembly.

The second bracket 640 may include a hanging portion 645. The hanging portion 645 may be formed on one side of the second bracket 640. The hanging portion 645 may extend from the supporting portion 641 of the second bracket 640. The hanging portion 645 may extend while bending from the supporting portion 641 of the second bracket 640. The hanging portion 645 may extend from the supporting portion 641 of the second bracket 640 on the same plane as the supporting portion 641 and may bend several times. The hanging portion 645 may be bent in a hook shape. The hanging portion 645 may be inserted into a portion of the second speaker unit 420.

Figure 29:
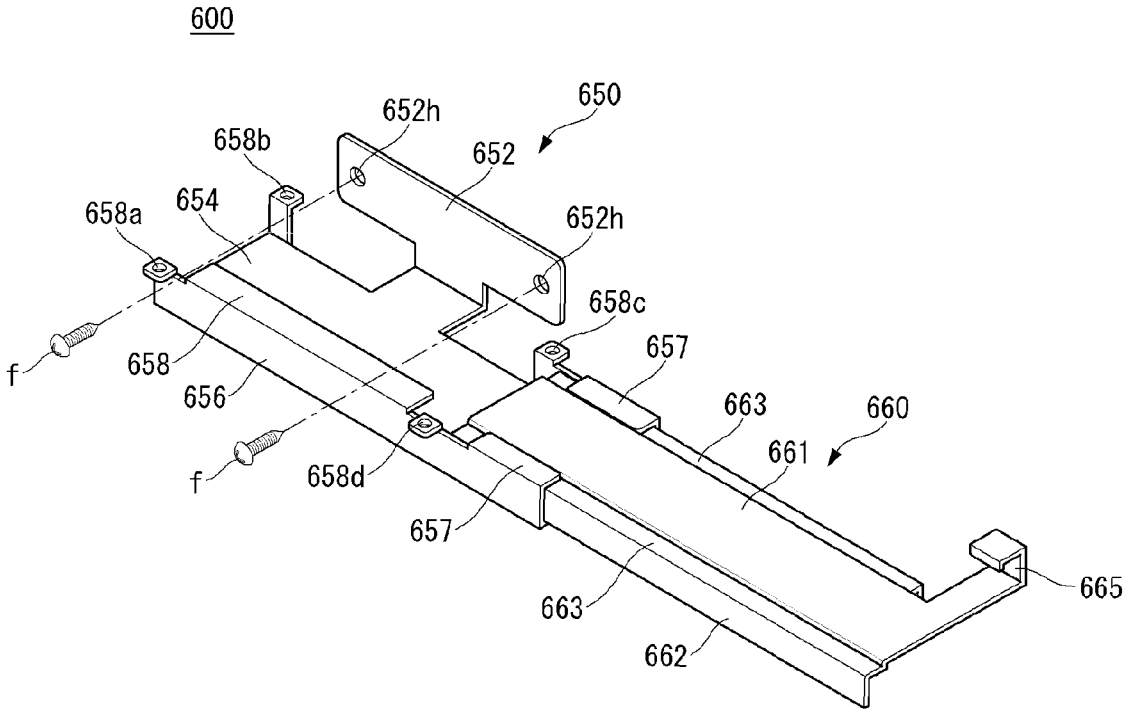
Figure 30:
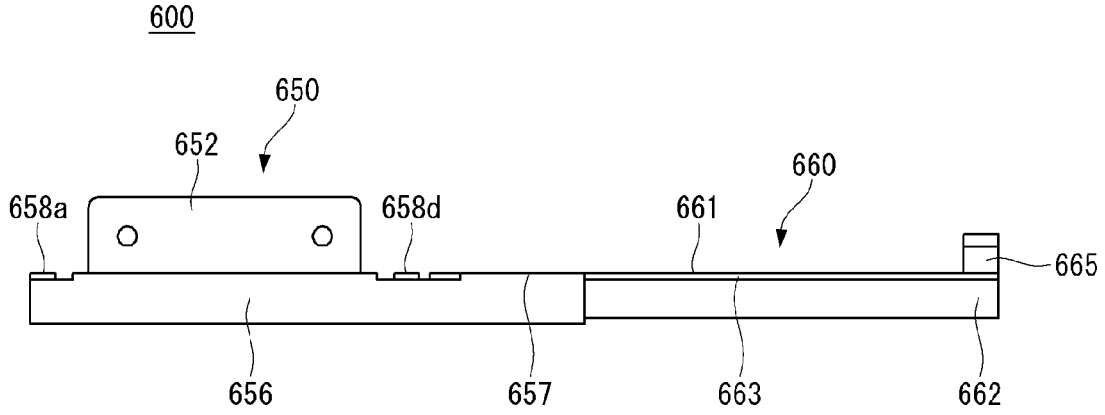

FIGS. 29 and 30 are views of another embodiment of the supporting structure of the speaker assembly. A first bracket 650 may slide from a second bracket 660. Alternatively, the second bracket 660 may slide from the first bracket 650. The second bracket 660 may be extended or expanded from the first bracket 650 in a longitudinal direction. The first bracket 650 may include a fixing portion 652. The fixing portion 652 may have a plate shape. The fixing portion 652 may be fixed to a wall surface, etc. through a coupling member f. The fixing portion 652 may be fixed to the wall surface, etc. through the coupling member f and a hole 652*h*. The coupling member f and the hole 652*h* may be omitted in the first bracket 650 in accordance with a fixing structure of the first bracket 650.

The first bracket 650 may include a bottom 654. The bottom 654 may form a bottom surface of the first bracket 650. The bottom 654 may be connected to the fixing portion 652. The bottom 654 may extend from the fixing portion 652. The bottom 654 may form one body along with the fixing portion 652. Alternatively, the bottom 634 may be formed separately from the fixing portion 652 and attached to the fixing portion 652. The bottom 654 may be formed by bending from the fixing portion 652. The bottom 654 may be formed by pressing the bottom 654 and the fixing portion 652 together. The bottom 654 may provide a supporting force in a direction opposite from gravity.

The first bracket 650 may include a supporting portion 658. The supporting portion 658 may be connected to the bottom 654. The supporting portion 658 may extend from the bottom 654. The supporting portion 658 may extend from one side of the bottom 654. A plurality of supporting portions 658*a*, 658*b*, 658*c*, and 658*d* may extend from one corner of the bottom 654. The plurality of supporting portions 658 may be formed on the bottom 654. The supporting portion 658*a* may be formed to upwardly extend from one corner of the bottom 654, and the supporting portion 658*b* may be formed to upwardly extend from another corner of the bottom 654. The supporting portion 658*c* may be formed to upwardly extend from one side of the bottom 654, and the supporting portion 658*d* may be formed to upwardly extend from another side of the bottom 654. The supporting portions 658*a* and 658*d* may be formed on a portion of a side wall 656 or may be formed by extending a portion of the side wall 656.

The first bracket 650 may have the side wall 656. The side wall 656 may be positioned between the bottom 654 and the supporting portion 658. The side wall 656 may be formed on one side of the bottom 654, and the supporting portion 658 may be formed on an upper side of the side wall 656. The supporting portion 658 may support the first speaker unit 410 or the second speaker unit 420. The side wall 656 may improve flexural rigidity of the first bracket 650. The supporting portion 658 may be formed to extend from the side wall 656. The supporting portion 658 may be formed by bending the side wall 656.

The first bracket 650 may include a slider 657. The slider 657 may be formed on one side of the bottom 654. The slider 657 may be formed by extending a portion of the bottom 654. The slider 657 may be formed by bending a portion of the bottom 654. The slider 657 may entirely have ⊏-shape. The slider 657 may be formed on both sides of the first bracket 650. The slider 657 may elongate along a longitudinal direction of the first bracket 650. Hence, the slider 657 may hold the second bracket 660.

The second bracket 660 may include a supporting portion 661. The supporting portion 661 may form a plane of the second bracket 660. The supporting portion 661 may support the first speaker unit 410 or the second speaker unit 420. The supporting portion 661 may be flat. The supporting portion 661 may be provided along a longitudinal direction of the second bracket 660. The supporting portion 661 may be positioned at a same height as the supporting portion 658. The supporting portion 658 of the first bracket 650 may support the first speaker unit 410, and the supporting portion 661 of the second bracket 660 may support the second speaker unit 420 because the first speaker unit 410 and the second speaker unit 420 may be coupled with each other and may be positioned at the same height. The supporting portion 661 may provide an expandability of the supporting portion 658.

The second bracket 660 may have a side wall 662. The side wall 662 may be formed on one side or both sides of the supporting portion 661. The side wall 662 may be formed by downwardly bending from the supporting portion 661. A height of the side wall 662 may be equal to a height of the side wall 656. The side wall 662 may be formed along the longitudinal direction of the supporting portion 661. The side wall 662 may improve the flexural rigidity of the first bracket 650. The second bracket 660 may include a rail 663. The rail 663 may be positioned between the side wall 662 and the supporting portion 661. The rail 663 may form a height difference between the supporting portion 661 and the side wall 662. When the slider 657 is placed on the rail 663, the height difference may be compensated. The slider 657 may wrap the rail 663. The slider 657 may partially or entirely wrap the rail 663. The slider 657 may wrap both the rail 663 and the side wall 656.

When the second bracket 660 moves along the longitudinal direction of the first bracket 650, the slider 657 may guide a movement of the second bracket 660 while sliding on the rail 663. Thus, the second bracket 660 may be inserted into an inside of the first bracket 650 or may extend to an outside of the first bracket 650. When the second bracket 660 is inserted into the inside of the first bracket 650, the supporting portion 658 of the first bracket 650 and the supporting portion 661 of the second bracket 660 may support the first speaker unit 410. Further, when the second bracket 660 extends to the outside of the first bracket 650, the supporting portion 658 of the first bracket 650 may support the first speaker unit 410, and the supporting portion 661 of the second bracket 660 may support the second speaker unit 420. Hence, the first and second bracket 650 and 660 may provide an expandable support of the speaker assembly.

The second bracket 660 may include a hanging portion 665. The hanging portion 665 may be formed on one side of the second bracket 660. The hanging portion 665 may extend from the supporting portion 661 of the second bracket 660. The hanging portion 665 may extend while bending from the supporting portion 661 of the second bracket 660. The hanging portion 665 may extend from the supporting portion 661 of the second bracket 660 on a same plane as the supporting portion 661 and may bend several times. The hanging portion 665 may be bent in a hook shape. The hanging portion 665 may be inserted into a portion of the second speaker unit 420. When the second speaker unit 420 is placed on the supporting portion 661, the hanging portion 665 may be positioned in a rear of the second speaker unit 420 or on a back surface of the second speaker unit 420. The hanging portion 665 may extend from the supporting portion 661 and may contact the back surface of the second speaker unit 420. Hence, the second speaker unit 420 may be prevented from being released.

Figure 31A:
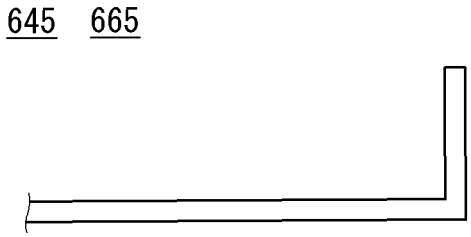
Figure 31B:
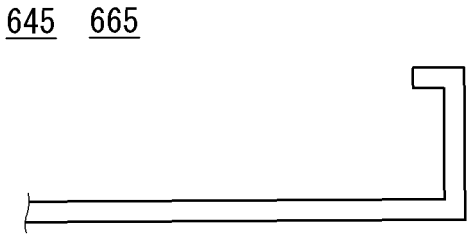
Figure 31C:
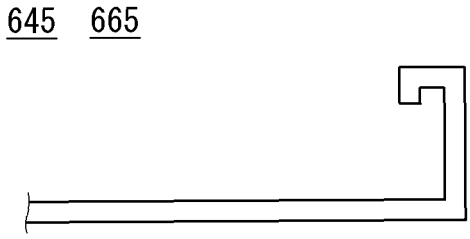

FIGS. 31A to 31C are views of a bracket included in the speaker assembly according to the embodiment. The hanging portions 645 and 665 may be variously modified. The hanging portions 645 and 665 may bend once. The hanging portions 645 and 665 may be in a ⊓-shape or a ⊔-shape. In this instance, the hanging portions 645 and 665 may contact the side of the second speaker unit 420. Hence, the hanging portions 645 and 665 may prevent the second speaker unit 420 from being released and detached from the second brackets 640 and 660.

The hanging portions 645 and 665 may bend twice. The hanging portions 645 and 665 may have ⊏⊐-shape. In this instance, the hanging portions 645 and 665 may contact the side of the second speaker unit 420 and also may be partially inserted into the inside of the second speaker unit 420. Hence, the hanging portions 645 and 665 may more efficiently prevent the second speaker unit 420 from being released and detached from the second brackets 640 and 660.

The hanging portions 645 and 665 may bend three times. The hanging portions 645 and 665 may have a hook shape.

In this instance, the hanging portions 645 and 665 may contact the side of the second speaker unit 420 and also may be partially inserted into the inside of the second speaker unit 420 and fixed. Hence, the hanging portions 645 and 665 may prevent the second speaker unit 420 from moving on the second brackets 640 and 660. The hanging portions 645 and 665 may cause the second speaker unit 420 to be stably positioned on the second brackets 640 and 660. The hanging portions 645 and 665 described with reference to FIGS. 31A to 31C may be applied to the bracket according to embodiments disclosed herein.

Figure 32:
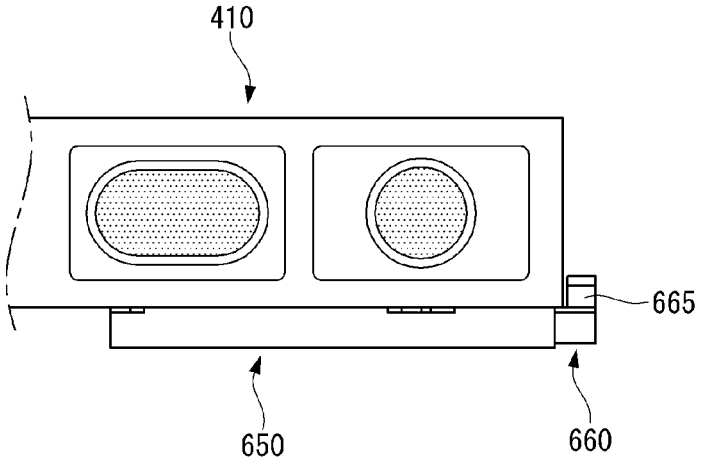

FIGS. 32 to 35 are views of coupling the supporting structure of the speaker assembly according to the embodiment. Referring to FIG. 32, the first bracket 650 may support the first speaker unit 410. The first speaker unit 410 may be placed on the first bracket 650. In this instance, the second bracket 660 may be positioned inside the first bracket 650 or on an upper side of the first bracket 650. In other words, the second bracket 660 may overlap the first bracket 650. The second bracket 660 may be positioned on the bottom 654 of the first bracket 650. The second bracket 660 may be positioned on one side of the side wall 656 of the first bracket 650. The second bracket 660 may slide on the first bracket 650 and may enter into the first bracket 650.

Figure 33:
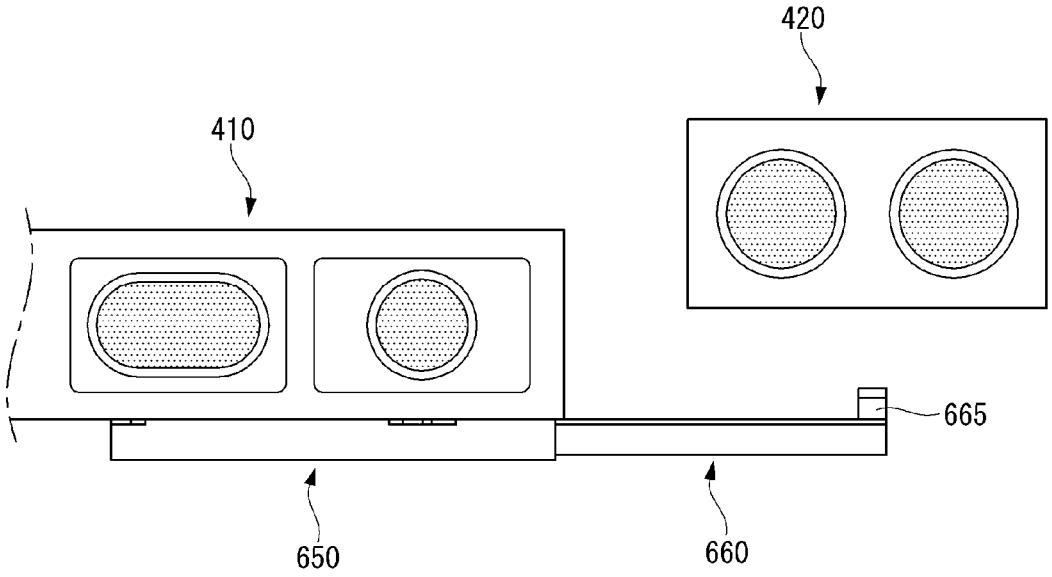

Referring to FIG. 33, the second bracket 660 may slide out of the first bracket 650. The second bracket 660 may extend from the first bracket 650 and may be positioned on one side of the first bracket 650. The one side of the first bracket 650 may be a side in the longitudinal direction of the first bracket 650. The second bracket 660 may be spread or extend to one side of the first bracket 650. The second bracket 660 may expand and be capable of supporting the first speaker unit 410 or the second speaker unit 420 on one side of the first bracket 650.

Figure 34:
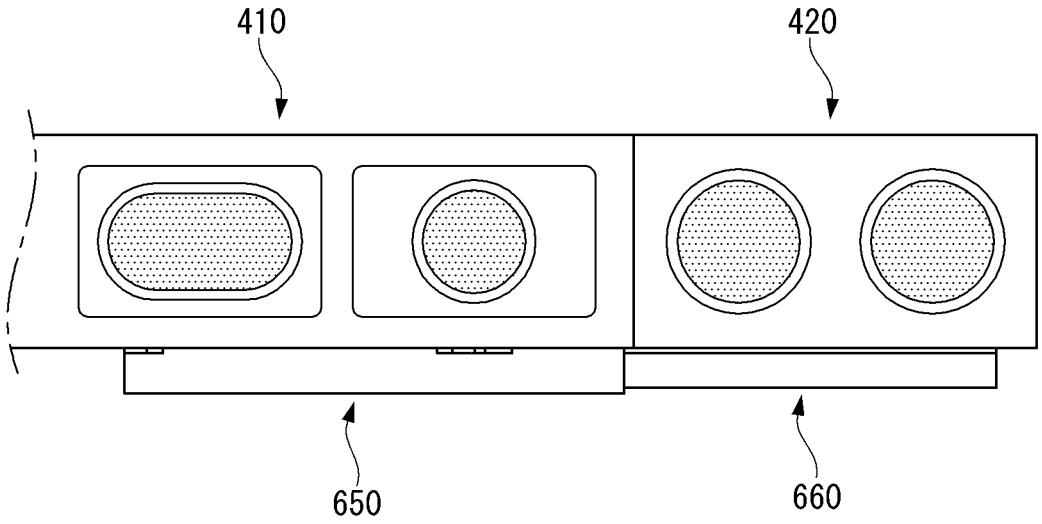

Referring to FIG. 34, the second speaker unit 420 may be placed on the second bracket 660. The second bracket 660 may support the second speaker unit 420. The second speaker unit 420 may be coupled with the first speaker unit 410. The second bracket 660 may stably support the second speaker unit 420 coupled with the first speaker unit 410. In other words, the second speaker unit 420 may be coupled with the first speaker unit 410 by a magnetic force. Further, even if an external force or an external impact is applied to the first speaker unit 410 or the second speaker unit 420, coupling of the first speaker unit 410 and the second speaker unit 420 may be maintained.

Figure 35:
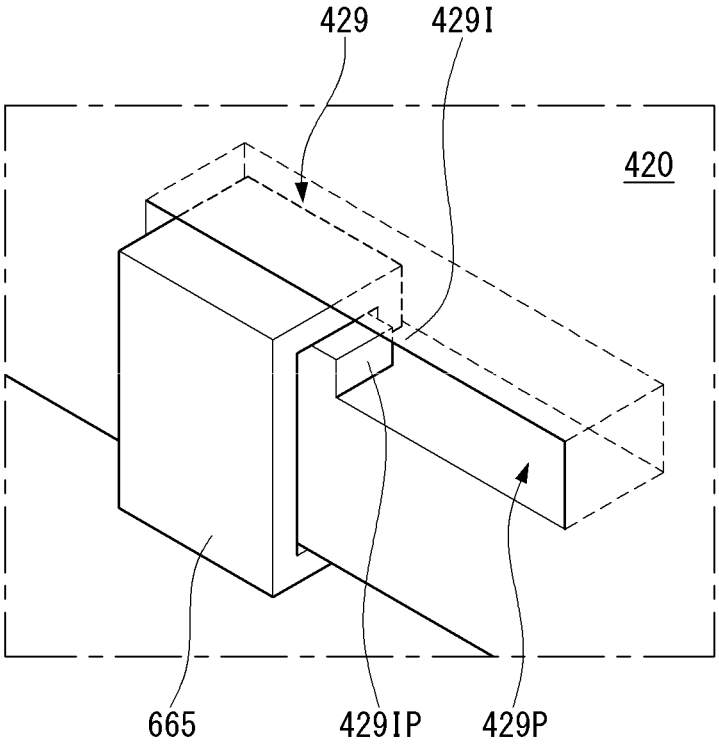

Referring to FIG. 35, the hanging portion 665 of the second bracket 660 may be inserted into one side of the second speaker unit 420. The second speaker unit 420 may have a fixing groove 429 on one side of the second speaker unit 420. The second speaker unit 420 may have a fixing groove 429 on the side surface or the back surface of the second speaker unit 420. The fixing groove 429 may be depressed towards the inside of the second speaker unit 420 so that the hanging portion 665 may be inserted into the fixing groove 429.

The second speaker unit 420 may include an opening 429P and an insertion portion 429I. The opening 429P may be formed on the side surface or the back surface of the second speaker unit 420. The opening 429P may extend from the back surface of the second speaker unit 420 into the inside of the second speaker unit 420. The insertion portion 429I may be connected to the opening 429P. The insertion portion 429I may be dug or carved from one side of the opening 429P into the inside of the second speaker unit 420. One side of the insertion portion 429I may be opened, and remaining sides may be closed. The opening 429P and the insertion portion 429I may form the fixing groove 429.

The hanging portion 665 may be inserted into the insertion portion 429I through the opening 429P. When the hanging portion 665 is inserted into the fixing groove 429, the second speaker unit 420 may be placed on the second bracket 660. When the second speaker unit 420 is coupled with the first speaker unit 410 by the magnetic force, the second bracket 660 may support the second speaker unit 420 and may provide the expandable support for the speaker assembly. Coupling of the first speaker unit 410 and the second speaker unit 420 may be maintained in spite of the external force or the external impact applied to the first speaker unit 410 and the second speaker unit 420.

Figure 36A:
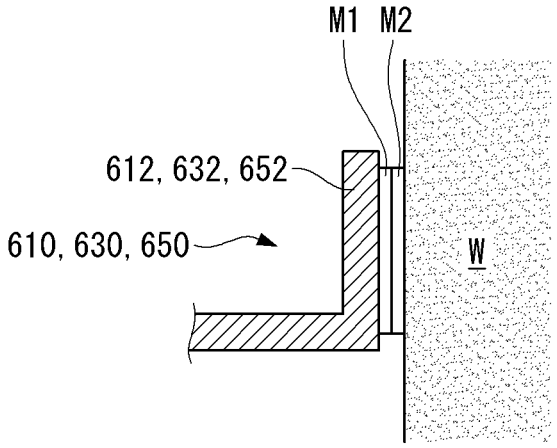
FIGS. 36A to 38B are views of fixing a supporting structure of a speaker assembly according to an embodiment.

FIGS. 36A to 38B are views of fixing a supporting structure of the speaker assembly according to the embodiment. Referring to FIG. 36A, each of the first brackets 610, 630, and 650 may include a magnetic body M1. The magnetic body M1 may be coupled with one surface of each of the first brackets 610, 630, and 650. For example, the magnetic body M1 may be coupled with the fixing portions 612, 632, and 652 of the first brackets 610, 630, and 650. The first brackets 610, 630, and 650 may be fixed to a wall surface W by the magnetic force. For example, the wall surface W may include a magnetic body M2 having a magnetic polarity different from the magnetic body M1 included in the first brackets 610, 630, and 650. Hence, the first brackets 610, 630, and 650 may be fixed to the wall surface W by the magnetic force.

Figure 36B:
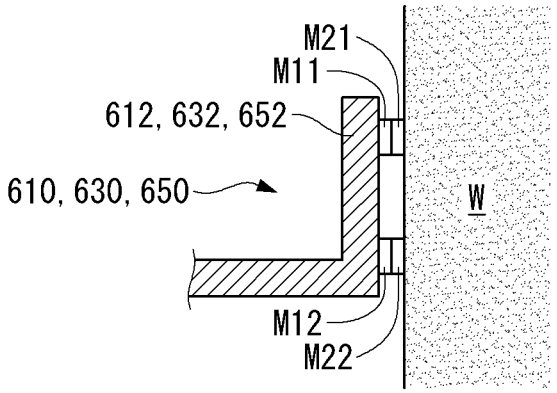

Referring to FIG. 36B, each of the first brackets 610, 630, and 650 may include a plurality of magnetic bodies. A first magnetic body M11 may be positioned on an upper part of each of the first brackets 610, 630, and 650, and a second magnetic body M12 may be positioned on a lower part of each of the first brackets 610, 630, and 650. The plurality of magnetic bodies may be included in the fixing portions 612, 632, and 652. The first magnetic body M11 may be positioned on an upper part or area of each of the fixing portions 612, 632, and 652, and the second magnetic body M12 may be positioned on a lower part or area of each of the fixing portions 612, 632, and 652. The wall surface W may include a third magnetic body M21 having a magnetic polarity different from the first magnetic body M11 and a fourth magnetic body M22 having a magnetic polarity different from the second magnetic body M12. Hence, the first brackets 610, 630, and 650 may be coupled with the wall surface W by the magnetic force.

Figure 37A:
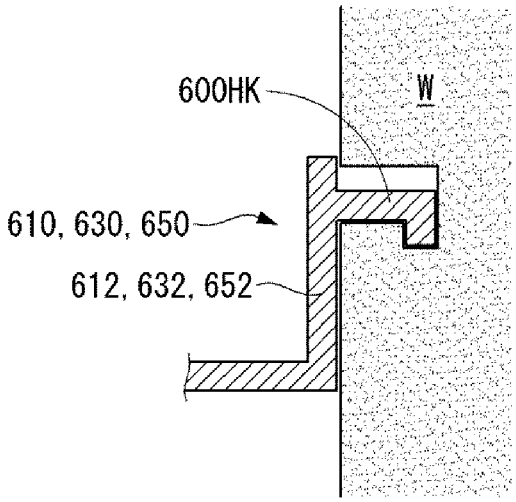

Referring to FIG. 37A, each of the first brackets 610, 630, and 650 may include a hook 600HK. The hook 600HK may be formed on one side of each of the first brackets 610, 630, and 650. The hook 600HK may be formed on one surface of each of the fixing portions 612, 632, and 652 of the first brackets 610, 630, and 650. The hook 600HK may be formed on a back surface of each of the fixing portions 612, 632, and 652 of the first brackets 610, 630, and 650. The wall surface W may include a hook groove. The first brackets 610, 630, and 650 may be fixed to the wall surface W by inserting the hook 600HK into the hook groove formed on the wall surface W.

Figure 37B:
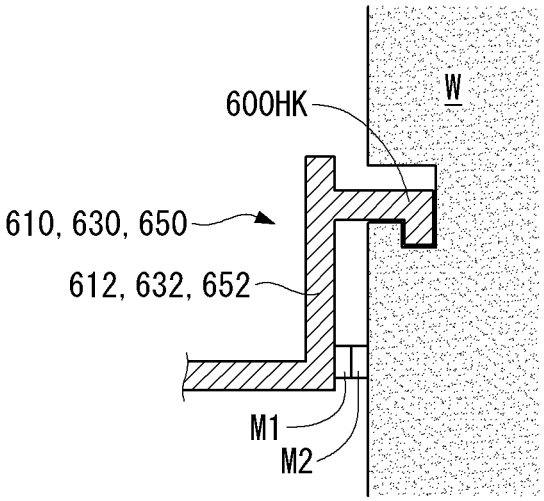

Referring to FIG. 37B, each of the first brackets 610, 630, and 650 may include a hook 600HK and a magnetic body M1. The hook 600HK may be formed on an upper part of each of the first brackets 610, 630, and 650. The magnetic body M1 may be formed on a lower part or area of each of the first brackets 610, 630, and 650. The hook 600HK may be formed on an upper part or area of each of the fixing portions 612, 632, and 652 of the first brackets 610, 630, and 650, and the magnetic body M1 may be formed on a lower part of each of the fixing portions 612, 632, and 652 of the first brackets 610, 630, and 650. The hook 600HK and/or the magnetic body M1 may be positioned on a back surface of each of the fixing portions 612, 632, and 652. The wall surface W may include a magnetic body M2 having a magnetic polarity different from the magnetic body M1. Hence, after the first brackets 610, 630, and 650 are fixed to the wall surface W, shaking may be prevented.

Figure 38A:
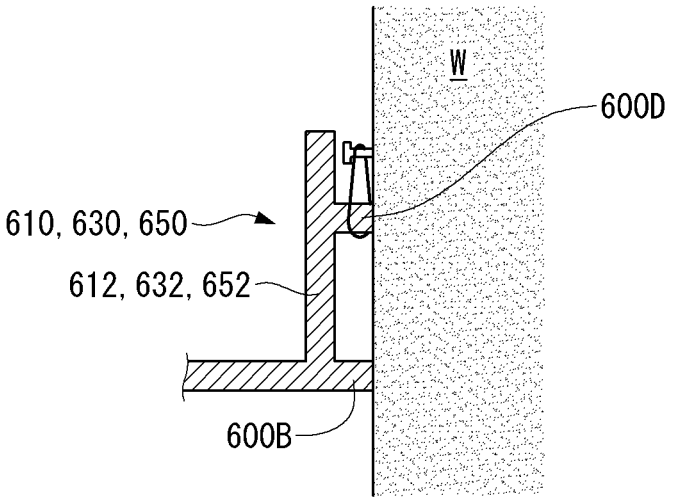

Referring to FIG. 38A, each of the first brackets 610, 630, and 650 may include a ring 600D. The ring 600D may be positioned on one side of each of the first brackets 610, 630, and 650. The ring 600D may be positioned on one surface of each of the fixing portions 612, 632, and 652 of the first brackets 610, 630, and 650. The hook 600HK may be positioned on the back surface of each of the fixing portions 612, 632, and 652 of the first brackets 610, 630, and 650. The wall surface W may include a nail. The first brackets 610, 630, and 650 may be fixed to the wall surface W by hanging the ring 600D on the nail formed on the wall surface W. In this instance, a supporting member 600B may be positioned on a lower part of each of the fixing portions 612, 632, and 652 so as to prevent shaking of the first brackets 610, 630, and 650.

Figure 38B:
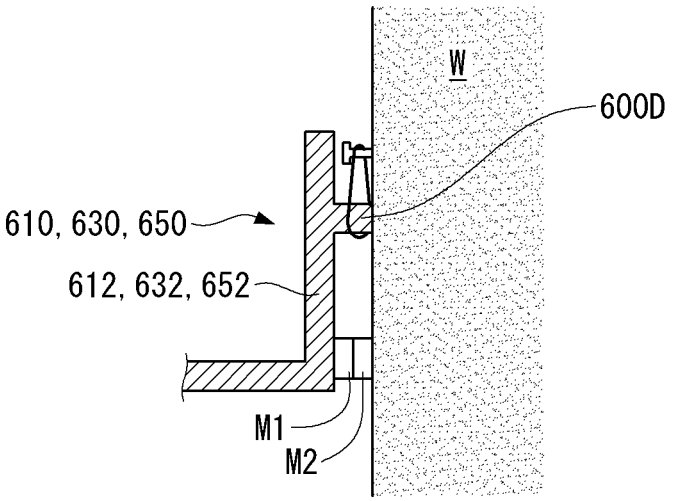

Referring to FIG. 38B, each of the first brackets 610, 630, and 650 may include a ring 600D and a magnetic body M1. The ring 600D may be positioned on the upper part of each of the first brackets 610, 630, and 650. The magnetic body M1 may be positioned on the lower part of each of the first brackets 610, 630, and 650. The ring 600D may be positioned on the upper part of each of the fixing portions 612, 632, and 652 of the first brackets 610, 630, and 650, and the magnetic body M1 may be positioned on the lower part of each of the fixing portions 612, 632, and 652 of the first brackets 610, 630, and 650. The ring 600D and/or the magnetic body M1 may be positioned on the back surface of each of the fixing portions 612, 632, and 652. The wall surface W may include a magnetic body M2 having a magnetic polarity different from the magnetic body M1. Hence, after the first brackets 610, 630, and 650 are fixed to the wall surface W, shaking may be prevented.

Embodiments disclosed herein provide a speaker assembly which may include a first speaker unit, a first magnetic body or magnet located on a side of the first speaker unit, a second speaker unit, a second magnetic body or magnet located on a side of the second speaker unit facing the side of the first speaker unit and having a magnetic polarity different from the first magnetic body, a first bracket positioned under the first speaker unit and supporting the first speaker unit, and a second bracket expanded from the first bracket, positioned under the second speaker unit, and supporting the second speaker unit.

The first bracket may include a bottom which is elongated, and a first supporting portion or support upwardly extending from one side of the bottom. The second bracket may include a second supporting portion or support elongated and positioned at the same height as the first supporting portion and a rail formed on one side of the second supporting portion along a longitudinal direction of the second supporting portion. The first bracket further may include a slider upwardly extending from one side of the bottom and wrapping the rail. The first bracket may include a first side wall positioned between the bottom and the first supporting portion. The second bracket may include a second side wall having the same height as a height of the first side wall, positioned on one side of the rail, and facing the first side wall. The slider may face the rail and the second side wall and may wrap the rail and the second side wall. The rail and the second supporting portion may form a height difference therebetween.

The first bracket may include a fixing portion connected to the bottom and a third magnetic body positioned on one surface of the fixing portion. The first bracket may include a fixing portion connected to the bottom and a hook positioned on one surface of the fixing portion. The first bracket may include a fourth magnetic body positioned to be separated from the hook and positioned on one surface of the fixing portion.

The second bracket may include a hanging portion extending from one side of the second bracket and bending. The second speaker unit may include a fixing groove, into which the hanging portion is inserted. The fixing groove may be formed on a back surface of the second speaker unit. The hanging portion may extend from one side of the second bracket toward the back surface of the second speaker unit and may bend.

Embodiments disclosed herein provide a speaker assembly which may include a first speaker including a first magnet provided on a side thereof, a second speaker including a second magnet provided on a side thereof, the second magnet having an opposite polarity than a polarity of the first magnet and facing the first magnet, a first bracket that supports the first speaker and including a slider that extends upward from a side of a bottom of the first bracket, and a second bracket configured to slide out from the first bracket that supports the second speaker and including a rail that extends longitudinally along a side of the second bracket, wherein the slider of the first bracket is configured to wrap around the rail of the second bracket.

Embodiments disclosed herein provide a speaker assembly which may include a first speaker including a first magnet provided on a side thereof, a second speaker including a second magnet provided on a side thereof and configured to couple to the first speaker via a magnetic connection between the first magnet and second magnet, a first bracket that supports the first speaker, and a second bracket configured to be rotatably connected to a bottom of the first bracket that supports the second speaker.

The first bracket may include a fixing portion that fixes the first bracket to a surface and a supporting portion that supports the first speaker including a rotation center and a rotation guide. The second bracket may be connected to the rotation center of the first bracket, and the rotation guide of the first bracket may maintain a predetermined distance between the first bracket and the second bracket.

The second bracket may include a rotating portion including a rotation hole configured to connect to the rotation center of the first bracket, a supporting portion that extends from the rotating portion, and a hanging portion that extends from the supporting portion. The rotating portion, the supporting portion, and the hanging portion may be stepped. The hanging portion may be inserted into a lower part of the second speaker. The second speaker may include a stepped portion and an insertion portion carved from a side of the stepped portion. The hanging portion may be inserted into the insertion portion through the stepped portion.

The terms 'first', 'second', etc. may be used to describe various components, but the components are not limited by such terms. The terms are used only for the purpose of distinguishing one component from other components. For example, a first component may be designated as a second component without departing from the scope of the present disclosure. In the same manner, the second component may be designated as the first component. The term "and/or"

encompasses both combinations of the plurality of related items disclosed and any item from among the plurality of related items disclosed.

When an arbitrary component is described as "being connected to" or "being linked to" another component, this should be understood to mean that still another component (s) may exist between them, although the arbitrary component may be directly connected to, or linked to, the second component. In contrast, when an arbitrary component is described as "being directly connected to" or "being directly linked to" another component, this should be understood to mean that no component exists between them.

The terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

Embodiments of the disclosure have been described using an organic light emitting diode (OLED) display panel as an example of a display panel. Other display panels may be used. For example, a liquid crystal display panel (LCD) panel, a plasma display panel (PDP), and a field emission display (FED) panel may be used.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A speaker assembly comprising:

a first speaker;

a first magnet provided on a side of the first speaker;

a second speaker;

a second magnet provided on a side of the second speaker that faces the side of the first speaker and having a magnetic polarity different from a magnetic polarity of the first magnet;

a first bracket provided under the first speaker to support the first speaker; and a second bracket provided under the second speaker to support the second speaker, wherein the second bracket is configured to slide out from the first bracket, wherein the second bracket includes a hanging portion having a bent shape that extends from a side of the second bracket, and wherein the second speaker includes a fixing groove, into which the hanging portion is inserted.

2. The speaker assembly of claim 1, wherein the first bracket includes a bottom, which is elongated, and a first support that extends upward from a side of the bottom, wherein the second bracket includes a second support, which is elongated and provided at a same height as a height of the first support, and a rail, which is formed on a side of the second support in a longitudinal direction, and wherein the first bracket further includes a slider that extends upward from the side of the bottom and wraps around the rail.

3. The speaker assembly of claim 2, wherein the first bracket includes a first side wall between the bottom and the first support, and wherein the second bracket includes a second side wall having a same height as a height of the first side wall, positioned on a side of the rail, and that faces the first side wall.

4. The speaker assembly of claim 3, wherein the slider faces the rail and the second side wall and wraps around the rail and the second side wall.

5. The speaker assembly of claim 2, wherein the rail and the second support form a height difference therebetween.

6. The speaker assembly of claim 2, wherein the first bracket includes:

a fixing portion connected to the bottom; and a third magnet provided on one surface of the fixing portion.

7. The speaker assembly of claim 2, wherein the first bracket includes:

a fixing portion connected to the bottom; and a hook provided on one surface of the fixing portion.

8. The speaker assembly of claim 7, wherein the first bracket includes a fourth magnet configured to separate from the hook and provided on one surface of the fixing portion.

9. The speaker assembly of claim 2, wherein the first bracket includes:

a fixing portion connected to the bottom of the first bracket; and a third magnet provided on a surface of the fixing portion that faces away from the first speaker.

10. The speaker assembly of claim 2, wherein the first bracket includes:

a fixing portion connected to the bottom of the first bracket; and a hook provided on a surface of the fixing portion that faces away from the first speaker.

11. The speaker assembly of claim 1, wherein the fixing groove is formed on a back surface of the second speaker, and wherein the hanging portion extends from the side of the second bracket toward the back surface of the second speaker.

12. A speaker assembly comprising:

a first speaker having a first magnet;

a second speaker having a second magnet, the second magnet having an opposite polarity than a polarity of the first magnet and facing the first magnet;

a first bracket that supports the first speaker and having a side that extends upward from a bottom of the first bracket, the side having a slider opposite from the bottom of the first bracket; and a second bracket configured to slide out from the first bracket and to support the second speaker, the second bracket having a rail that extends longitudinally along a side of the second bracket, wherein the slider of the first bracket is configured to wrap around the rail of the second bracket.

13. A speaker assembly comprising:

a first speaker having a first magnet;

a second speaker having a second magnet and configured to couple to the first speaker via a magnetic connection between the first magnet and second magnet;

a first bracket to support the first speaker; and a second bracket coupled to the first bracket to support the second speaker, wherein the first bracket includes:

a fixing portion that fixes the first bracket to a surface; and a first support that supports the first speaker, wherein the second bracket includes:

a second support; and a hanging portion that extends from the second support, wherein the second support, and the hanging portion are stepped, wherein the hanging portion is configured to be inserted into a lower part of the second speaker, and wherein the second speaker includes a stepped portion; and an insertion portion carved from a side of the stepped portion, and the hanging portion is inserted into the insertion portion through the stepped portion.

* * * * *